US009251741B2

(12) United States Patent
Umezaki

(10) Patent No.: US 9,251,741 B2
(45) Date of Patent: Feb. 2, 2016

(54) LIQUID CRYSTAL DISPLAY DEVICE AND DRIVING METHOD

(75) Inventor: Atsushi Umezaki, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 497 days.

(21) Appl. No.: 13/084,030

(22) Filed: Apr. 11, 2011

(65) Prior Publication Data

US 2011/0254816 A1 Oct. 20, 2011

(30) Foreign Application Priority Data

Apr. 14, 2010 (JP) ..... 2010-093394

(51) Int. Cl.
*G09G 3/34* (2006.01)
*G09G 5/00* (2006.01)

(52) U.S. Cl.
CPC ..... *G09G 3/344* (2013.01); *G09G 3/3433* (2013.01); *G09G 2300/08* (2013.01); *G09G 2310/0248* (2013.01); *G09G 2310/0251* (2013.01); *G09G 2310/0272* (2013.01)

(58) Field of Classification Search
CPC ..... G09G 3/3433
USPC ..... 345/107, 204
See application file for complete search history.

(56) References Cited

U.S. PATENT DOCUMENTS

| | | | | |
|---|---|---|---|---|
| 6,373,461 | B1 | 4/2002 | Hasegawa et al. | |
| 6,504,522 | B2 | 1/2003 | Shiraki et al. | |
| 6,842,166 | B2 | 1/2005 | Hasegawa et al. | |
| 7,173,602 | B2 | 2/2007 | Hasegawa et al. | |
| 8,179,392 | B2 | 5/2012 | Kida et al. | |
| 8,264,454 | B2 | 9/2012 | Kim et al. | |
| 8,334,862 | B2 | 12/2012 | Shirai | |
| 8,384,656 | B2 | 2/2013 | Ito | |
| 2003/0112211 | A1* | 6/2003 | Hector | 345/87 |
| 2003/0179164 | A1* | 9/2003 | Shin et al. | 345/76 |
| 2005/0225526 | A1* | 10/2005 | Chiu et al. | 345/98 |
| 2006/0044296 | A1* | 3/2006 | Murade | 345/204 |
| 2006/0087488 | A1* | 4/2006 | Ito | 345/103 |
| 2006/0103618 | A1* | 5/2006 | Miura | 345/96 |
| 2006/0262081 | A1 | 11/2006 | Zhou et al. | |
| 2007/0046622 | A1 | 3/2007 | Kawai | |
| 2007/0139358 | A1* | 6/2007 | Sakamoto | 345/107 |
| 2010/0085628 | A1 | 4/2010 | Lee | |
| 2013/0100111 | A1 | 4/2013 | Shirai | |

FOREIGN PATENT DOCUMENTS

| | | | |
|---|---|---|---|
| JP | 02-204718 | A | 8/1990 |
| JP | 11-052931 | A | 2/1999 |
| JP | 11-160730 | A | 6/1999 |
| JP | 2000-221546 | A | 8/2000 |
| JP | 2004-102055 | A | 4/2004 |
| JP | 2008-046485 | A | 2/2008 |
| JP | 2008-145556 | A | 6/2008 |
| JP | 2009-116247 | A | 5/2009 |
| JP | 2009-122157 | A | 6/2009 |
| JP | 2009-163246 | A | 7/2009 |
| TW | 200828236 | | 7/2008 |

OTHER PUBLICATIONS

Taiwanese Office Action (Application No. 100112458) Dated Sep. 2, 2015.

* cited by examiner

*Primary Examiner* — Adam J Snyder
(74) *Attorney, Agent, or Firm* — Fish & Richardson P.C.

(57) ABSTRACT

A display device comprising a display area in which a plurality of pixels, a plurality of gate signal lines, and a plurality of source signal lines are arranged in a matrix; a scan line driver circuit having a function of controlling a timing of selecting any one of the plurality of gate signal lines; and a signal line driver circuit having a function of controlling, in a period during which the scan line driver circuit selects any one of the plurality of gate signal lines, a timing of outputting a first signal to all the plurality of source signal lines and then outputting a second signal to any one of the plurality of source signal lines. Each of the plurality of pixels includes a transistor and a display element being sandwiched between a pixel electrode and a common electrode and having memory properties.

8 Claims, 23 Drawing Sheets

LIQUID CRYSTAL DISPLAY DEVICE AND DRIVING METHOD

BACKGROUND OF THE INVENTION

1. Field of the Invention

The field of the present invention relates to a liquid crystal display device or a display device such as an electrophoretic display device and to the driving method thereof.

2. Description of the Related Art

In recent years, display devices such as electronic book readers have been actively developed. In particular, a technique of displaying an image by using a display element having memory properties greatly contributes to a reduction in power consumption and thus has been actively developed.

Patent Document 1 discloses an active-matrix electrophoretic display device. In the electrophoretic display device of Patent Document 1, analog switches are placed between a single data signal line and a plurality of data lines. A data signal is input to the data signal line. The plurality of data lines are connected to a plurality of pixels. In one gate selection period, the plurality of analog switches are sequentially turned on, thereby inputting data signals sequentially to the plurality of data lines. The data signals that have been input to the data lines are input to the pixels connected to the data lines.

REFERENCE

Patent Document

[Patent Document 1] Japanese Published Patent Application No. 2000-221546

SUMMARY OF THE INVENTION

However, in a conventional technique, in one gate selection period, a data signal for a pixel in the previous row is input to a pixel from the start of one gate selection period until a data signal is input to a data signal line connected to the pixel (until an analog switch connected to the pixel through the data line turns on). In other words, in one gate selection period there is a time during which an incorrect voltage is applied to a display element included in a pixel. A display element having memory properties such as an electrophoretic element is adversely affected by application of an incorrect voltage to the display element. This causes the problem of deviations in the grayscale of the display element.

In view of the above problem, an object of one embodiment of the present invention is to eliminate or shorten the time during which an incorrect voltage is applied to a display element in a pixel. An object of one embodiment of the present invention is to eliminate or reduce deviations in the grayscale of the display element. An object of one embodiment of the present invention is to provide a display device for achieving any one of these objects. Note that one embodiment of the present invention achieves at least one of the above objects.

One embodiment of the present invention is a display device including a display area in which a plurality of pixels, a plurality of gate signal lines, and a plurality of source signal lines are arranged in a matrix; a scan line driver circuit; and a signal line driver circuit. The scan line driver circuit has a function of controlling a timing of selecting any one of the plurality of gate signal lines. The signal line driver circuit has a function of controlling, in a period during which the scan line driver circuit selects any one of the plurality of gate signal lines, a timing of outputting a first signal to all the plurality of source signal lines and then outputting a second signal to any one of the plurality of source signal lines. Each of the plurality of pixels includes a transistor and a display element being sandwiched between a pixel electrode and a common electrode and having memory properties. A first terminal of the transistor is electrically connected to any one of the plurality of source signal lines. A second terminal of the transistor is electrically connected to the pixel electrode. A gate of the transistor is electrically connected to any one of the plurality of gate signal lines.

One embodiment of the present invention is a display device including a display area in which a plurality of pixels, a plurality of gate signal lines, and a plurality of source signal lines divided into N groups (N is a natural number) are arranged in a matrix; a scan line driver circuit; and a signal line driver circuit. The scan line driver circuit has a function of controlling a timing of selecting any one of the plurality of gate signal lines. The signal line driver circuit has a function of controlling, in a period during which the scan line driver circuit selects any one of the plurality of gate signal lines, a timing of outputting a first signal to all the plurality of source signal lines divided into N groups and then outputting a second signal sequentially to the plurality of source signal lines divided into N groups, group by group. Each of the plurality of pixels includes a transistor and a display element being sandwiched between a pixel electrode and a common electrode and having memory properties. A first terminal of the transistor is electrically connected to any one of the plurality of source signal lines. A second terminal of the transistor is electrically connected to the pixel electrode. A gate of the transistor is electrically connected to any one of the plurality of gate signal lines.

One embodiment of the present invention is a display device including a display area in which a plurality of pixels, a plurality of gate signal lines, and a plurality of source signal lines divided into N groups (N is a natural number) are arranged in a matrix; a scan line driver circuit; and a signal line driver circuit. The scan line driver circuit has a function of controlling a timing of selecting any one of the plurality of gate signal lines. The signal line driver circuit has a function of controlling a timing of outputting a first signal to the source signal lines in the second to N-th groups, and then outputting a second signal to the source signal lines in the first group, and then outputting a second signal sequentially to the source signal lines in the second to N-th groups, group by group. Each of the plurality of pixels includes a transistor and a display element being sandwiched between a pixel electrode and a common electrode and having memory properties. A first terminal of the transistor is electrically connected to any one of the plurality of source signal lines. A second terminal of the transistor is electrically connected to the pixel electrode. A gate of the transistor is electrically connected to any one of the plurality of gate signal lines.

A potential of the first signal may be equal to a potential of the common electrode.

An absolute value of a difference between a potential the first signal and a potential of the common electrode may be lower than an absolute value of a threshold voltage of the display element.

The second signal may have three values: a value approximately the same as a potential of the common electrode, a value higher than the potential of the common electrode, and a value lower than the potential of the common electrode.

One embodiment of the present invention can eliminate or shorten the time during which an incorrect voltage is applied to a display element in a pixel. Further, one embodiment of the present invention can eliminate or reduce deviations in the grayscale of the display element.

DETAILED DESCRIPTION OF THE INVENTION

Figure 1:
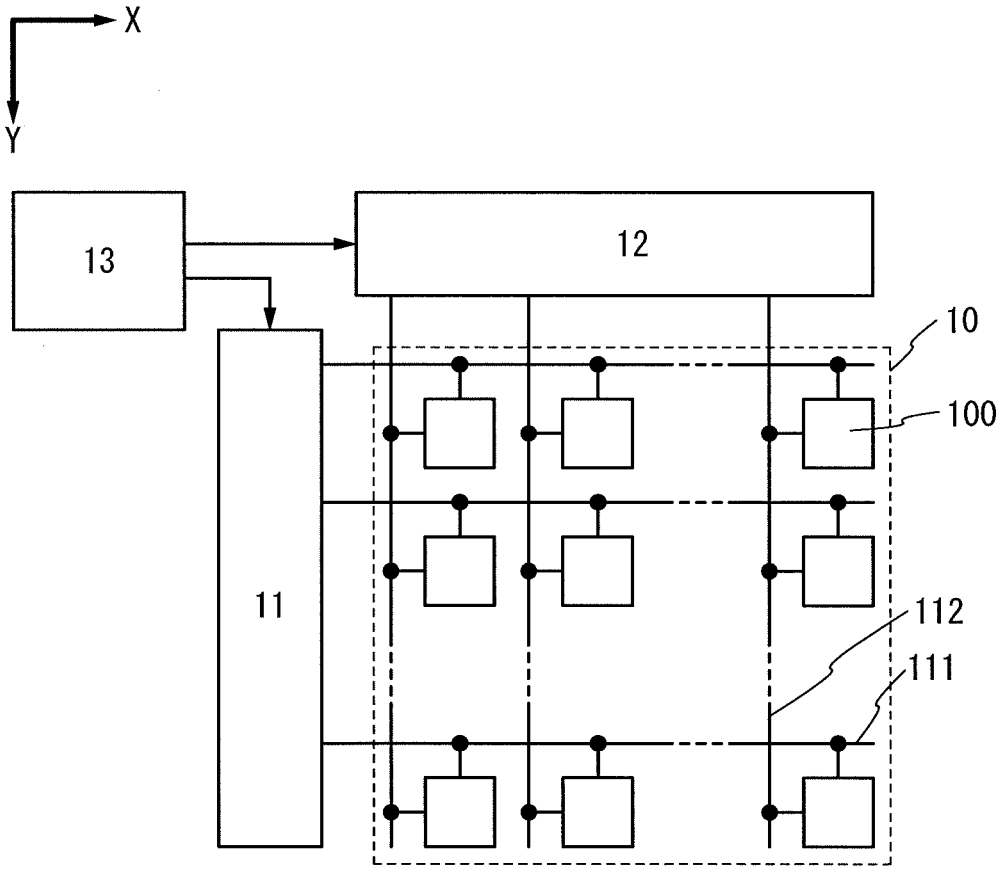
FIG. 1 is a diagram illustrating a display device according to one embodiment of the present invention.

Hereinafter, embodiments of the present invention will be described in detail with reference to the accompanying drawings. Note that the present invention is not limited to the description below, and it is easily understood by those skilled in the art that a variety of changes and modifications can be made without departing from the spirit and scope of the present invention. Therefore, the present invention should not be limited to the descriptions of the embodiments below. Note that, in the structure of the present invention described below, identical objects in all the drawings are denoted by the same reference numeral.

Note that the size, layer thickness, signal waveform, and region of each structure shown in the drawings and the like of the embodiments are exaggerated for simplicity in some cases. Therefore, the embodiments of the present invention are not necessarily limited to such scales.

Note that terms such as "first", "second", "third", to "N (N is a natural number)" used in this specification are used only for preventing confusion between components, and thus do not limit numbers.

Embodiment 1

In Embodiment 1, a display device that is one embodiment of the present invention and the driving method thereof will be described.

First, a structural example of the display device of Embodiment 1 will be described below with reference to FIG. 1.

A display device shown in FIG. 1 includes a display area 10 (also referred to as a pixel area) in which a plurality of pixels 100 are arranged in a matrix; driver circuits for driving the pixels such as a scan line driver circuit 11 and a signal line driver circuit 12; and a controller 13 for controlling the driver circuits such as the scan line driver circuit 11 and the signal line driver circuit 12.

In the display area 10, n (n is a natural number) gate signal lines 111 (gate signal lines 111_1 to 111_*n*) extended from the scan line driver circuit 11 in the X direction, and m (m is a natural number) source signal lines 112 (source signal lines 112_1 to 112_*m*) extended from the signal line driver circuit 12 in the Y direction are formed. The pixel 100 is formed in each of the portions where the n gate signal lines 111 and the m source signal lines 112 intersect. In other words, the plurality of pixels 100 are in a matrix with n rows and m columns. The gate signal lines 111 are wirings having a function of transferring an output signal of the scan line driver circuit 11 (e.g., a gate signal), and are also called wirings or signal lines. The source signal lines 112 are wirings having a function of transferring an output signal of the signal line driver circuit 12 (e.g., an image signal), and are also called wirings or signal lines.

Note that for convenience sake, the pixels 100 electrically connected to the gate signal line 111 in the i-th row (i is any one of 1 to n) are referred to as the pixels 100 in the i-th row. Further, the pixels 100 electrically connected to the source signal line 112 in the j-th column (j is any one of 1 to m) are referred to as the pixels 100 in the j-th column.

Note that the m source signal lines 112 are divided into N (N is a natural number) groups. Each group includes one or more source signal lines 112. Preferably, the groups include the same number of the source signal lines 112.

Note that for convenience sake, the pixels 100 electrically connected to the source signal line 112 in the k-th group (k is any one of 1 to N) is referred to as the pixels 100 in the k-th group.

Note that the display area 10 may include various wirings in addition to the gate signal lines 111 and the source signal lines 112, depending on the configuration of the pixel 100. Examples of the wirings that the display area 10 can include are capacity lines, power supply lines, signal lines, and gate signal lines different from the gate signal lines 111.

Note that a dummy pixel or a dummy wiring (e.g., a dummy gate signal line or a dummy source signal line) may be formed on the periphery of the display area 10. This reduces display defects in the display area 10.

The scan line driver circuit 11 has a function of sequentially selecting the pixels 100 in the first to n-th rows, and is also called a driver circuit or gate driver. The timing of selecting the pixels 100 is controlled by an operation in which the scan line driver circuit 11 outputs a gate signal (also referred to as a scan signal) to the n gate signal lines 111. To select the pixels 100 in the i-th row, for example, the scan line driver circuit 11 forces a gate signal output to the i-th gate signal line 111 into a selected state (sets the gate signal one of high and low). Here, if the pixels 100 except the pixels 100 in the i-th row are not supposed to be selected, the scan line driver circuit 11 forces a gate signal output to the gate signal lines 111 except the gate signal line 111 in the i-th row into a non-selected state (sets the gate signal the other of high and low).

Note that the scan line driver circuit 11 includes a shift register circuit, a decoder circuit, or the like. When the scan line driver circuit 11 includes a shift register circuit, the number of signals needed for driving the scan line driver circuit 11 can be reduced. In addition, when the scan line driver circuit 11 includes a decoder circuit, the scan line driver circuit 11 can select n rows of pixels 100 row by row in a predetermined order.

Note that the scan line driver circuit 11 may select only some of the pixels 100 from the n rows of pixels 100. This reduces the number of rows to be selected, thereby reducing power consumption.

The signal line driver circuit 12 has a function of controlling the timing of inputting an initialization signal (also referred to as a first signal) and then an image signal (also referred to as a second signal) to each pixel 100, and is also called a driver circuit or source driver. In other words, the signal line driver circuit 12 outputs an initialization signal and then an image signal to the source signal lines 112. An image signal is a signal based on image data. Input of the initialization signal and the image signal to each pixel 100 is performed as follows: the scan line driver circuit 11 outputs an initialization signal to the source signal lines 112 in all groups at once every time the scan line driver circuit 11 selects the pixel 100 in each row, and then outputs an image signal sequentially to the source signal lines 112 in the first to N-th groups, group by group. The source signal line 112 is initialized every time the pixel 100 is selected to have a predetermined potential in this way, preventing an image signal for the previous pixel 100 from being input to the pixel 100. Therefore, an incorrect voltage is not applied to the display element in the pixel 100, thereby reducing display defects such as deviations in the grayscale.

Note that the signal line driver circuit may output an image signal to the source signal line 112 in one group (e.g., the first group) and an initialization signal to the source signal lines 112 in other groups (e.g., the second to N-th groups), and then output an image signal sequentially to these source signal lines 112 in the other groups, group by group. This shortens one gate selection period, providing a high-definition display device. In other words, this lengthens the time during which an image signal is input to each pixel 100, thereby allowing an image signal with a correct value to be held in each pixel 100 and improving display quality.

The controller 13 has a function of controlling driver circuits such as the scan line driver circuit 11 and the signal line driver circuit 12 in accordance with image data, and is also called a control circuit or a timing controller. Driver circuits such as the scan line driver circuit 11 and the signal line driver circuit 12 are controlled by an operation in which the controller 13 supplies various control signals to driver circuits such as the scan line driver circuit 11 and the signal line driver circuit 12. For example, the controller 13 supplies a control signal such as a vertical synchronization signal, a clock signal, or a pulse width control signal to the scan line driver circuit 11. For example, the controller 13 supplies an image signal and a control signal such as a horizontal synchronization signal, a clock signal, or a latch signal to the signal line driver circuit 12.

Note that the controller 13 may supply not only a signal but a voltage to driver circuits such as the scan line driver circuit 11 and the signal line driver circuit 12. In this case, the controller circuit preferably includes a power supply circuit such as DCDC converter and/or a regulator circuit. Note that it is possible to achieve a reduction in the number of components and a reduction in cost, and/or improvement in yield by forming this power supply circuit and the circuit for supplying a signal to driver circuits such as the scan line driver circuit 11 and the signal line driver circuit 12, over the same substrate (on one chip).

Figure 2:
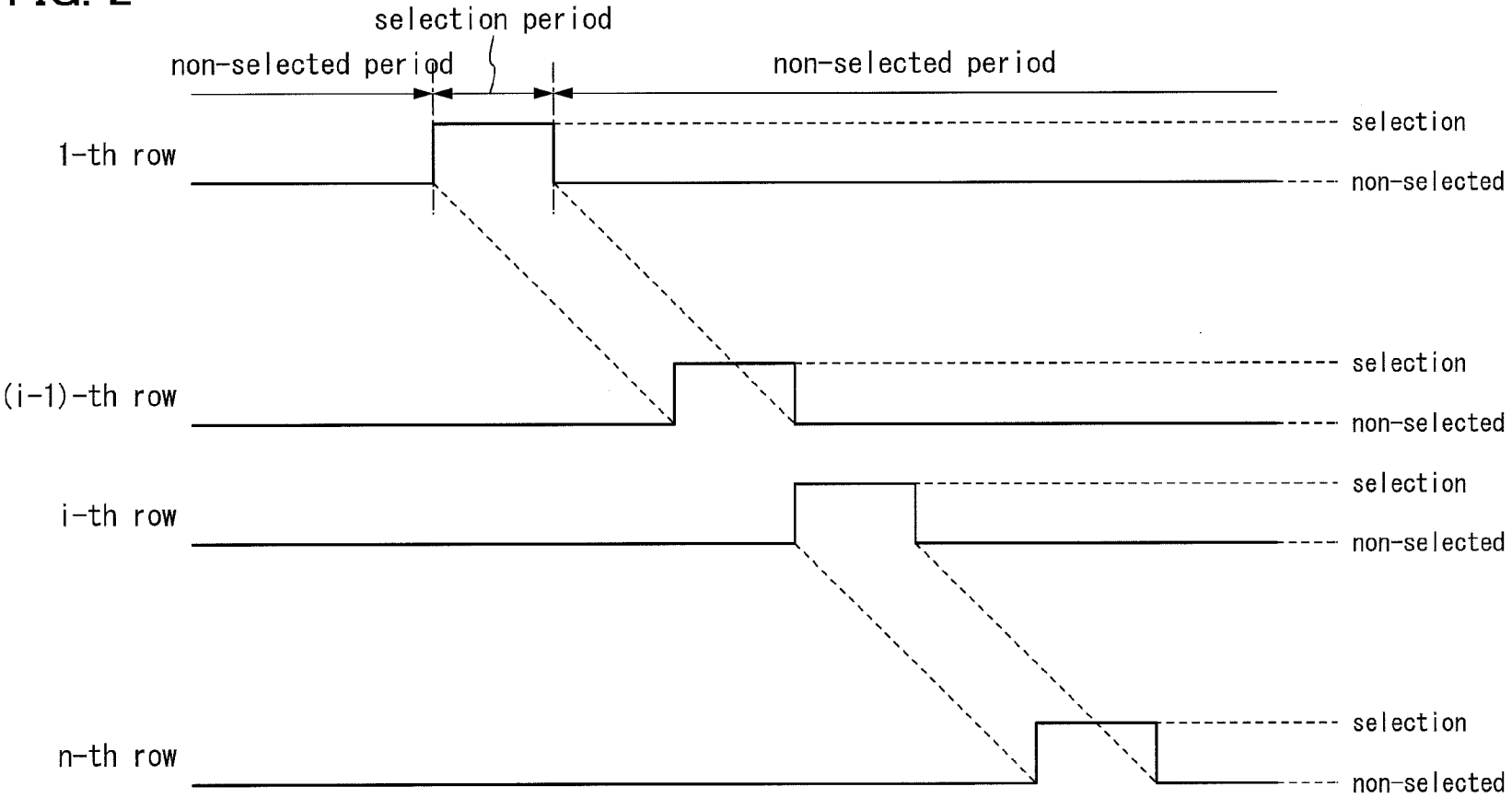
FIG. 2 is a diagram illustrating the display device according to one embodiment of the present invention.

Next, the driving method of the display device of Embodiment 1 will be roughly described with reference to FIG. 2. FIG. 2 is an example of the timing diagram showing an operation in which the scan line driver circuit 11 sequentially selects the first to n-th rows, row by row.

Note that for convenience sake, an image signal is referred to as a signal Data. The signal Data input to the pixels 100 in the i-th row is specially referred to as a signal Data (i).

Note that for convenience sake, an initialization signal is referred to as a signal the signal RST.

The signal RST and then the signal Data are input to the pixels 100 in a row selected by the scan line driver circuit 11. For example, when the scan line driver circuit 11 selects the (i−1)-th row, the signal RST and then a signal Data (i−1) are input to the pixels 100 in the (i−1)-th row. Then, the pixels 100 in the (i−1)-th row hold a voltage or charge according to the signal Data (i−1). Subsequently, the pixels 100 in the (i−1)-th row produce gradations according to the signal Data (i−1). At the same time, the scan line driver circuit 11 does not select the first to (i−2)-th rows and the i-th to n-th rows. Consequently, a signal is not input to the pixels 100 in the first to (i−2)-th rows and the i-th to n-th rows.

In the next step, the scan line driver circuit 11 stops selecting the (i−1)-th row, and selects the i-th row. Thus, a signal is not input to the pixels 100 in the (i−1)-th row any more. However, the pixels 100 in the (i−1)-th row hold the signal Data (i−1), and thus still have the gradations according to the signal Data (i−1). Next, the signal RST and then the signal Data (i) are input to the pixels in the i-th row. Then, the pixels 100 in the i-th row hold a voltage or charge according to the signal Data (i). Consequently, the pixels 100 in the i-th row produce gradations according to the signal Data (i). At the same time, the scan line driver circuit 11 still does not select the first to (i−2)-th rows and the (i+1)-th to n-th rows. As a result, a signal is still not input to the pixels 100 in the first to (i−2)-th rows and the (i+1)-th to n-th rows.

Such operations are repeated in each row, so that the signal Data can be held in each pixel 100.

Figure 3:
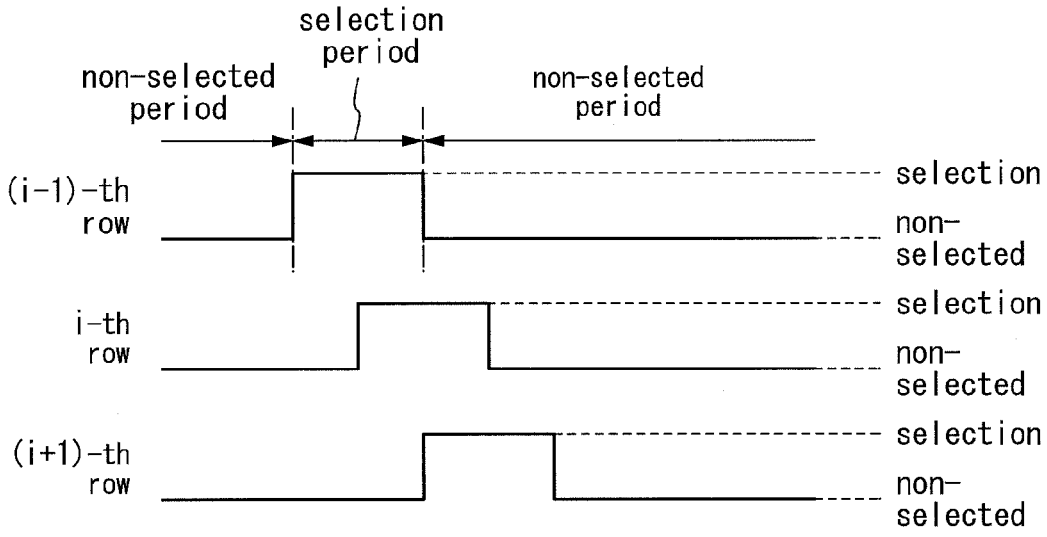
FIG. 3 is a diagram illustrating the display device according to one embodiment of the present invention.

Note that in the timing diagram of FIG. 2, the scan line driver circuit 11 may starts to select, before ending the selection of one row, another row as shown in FIG. 3. In other words, a period in which two or more rows are simultaneously selected may exist. This lowers the drive frequency of the scan line driver circuit 11, thereby reducing power consumption.

Figure 4:
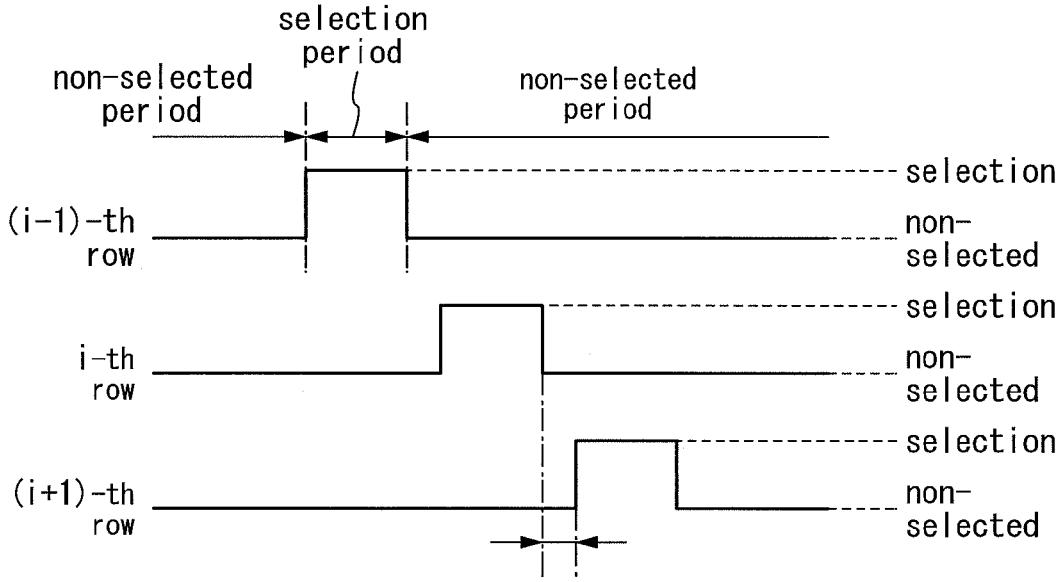
FIG. 4 is a diagram illustrating the display device according to one embodiment of the present invention.

Note that in the timing diagram of FIG. 2, the scan line driver circuit 11 may starts to select, a predetermined time after ending the selection of one row, the next row as shown in FIG. 4. To achieve such an operation, it is preferable that the controller 13 output a balanced clock signal and a signal for controlling the pulse width to the scan line driver circuit 11. Alternatively, it is preferable that the controller 13 output an unbalanced clock signal to the scan line driver circuit 11. Note that an unbalanced signal is a signal that is not balanced. In one cycle, the length of a period during which an unbalanced signal is high is different from that of a period during which the unbalanced signal is low.

Figure 5:
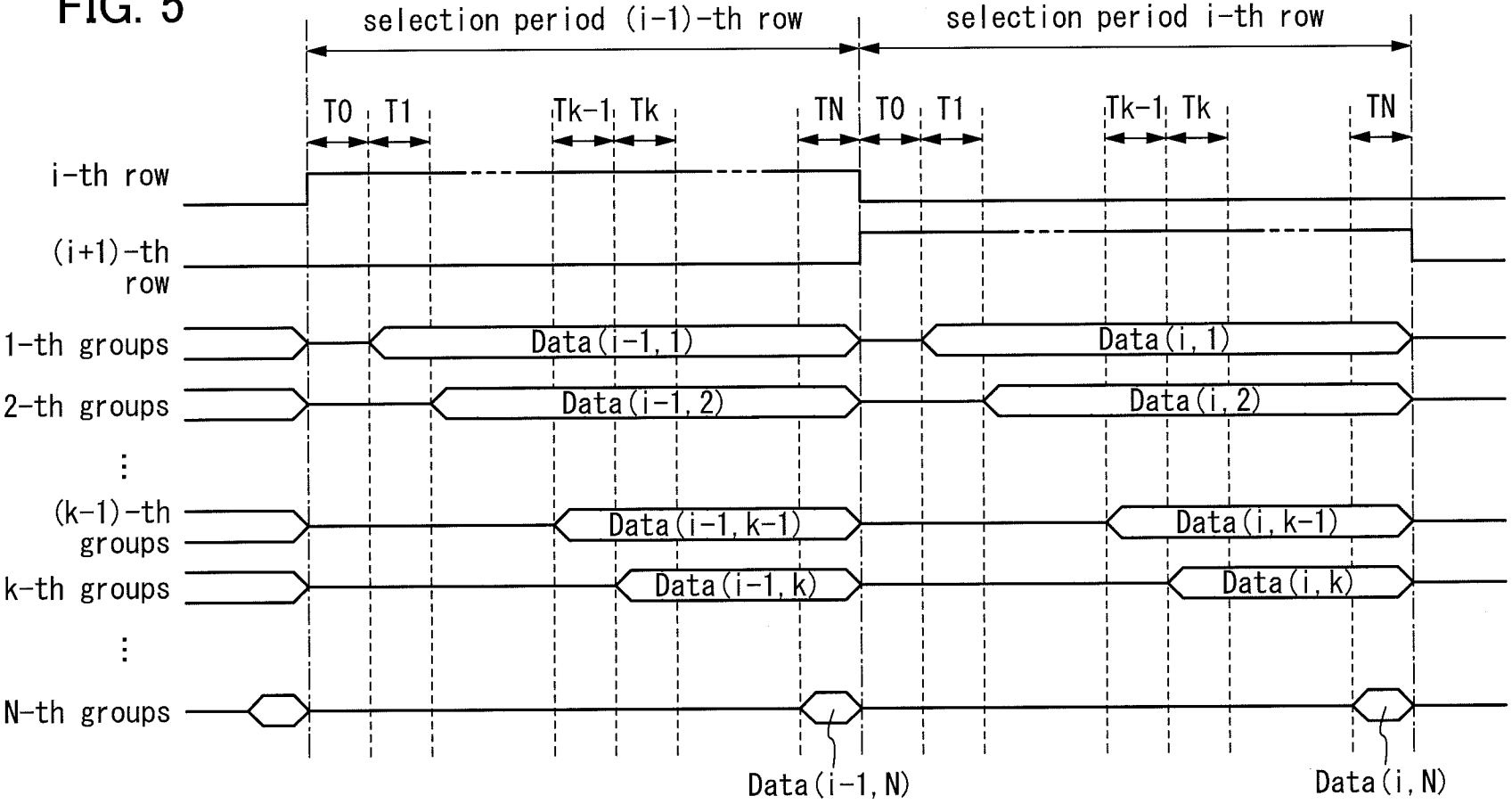
FIG. 5 is a diagram illustrating the display device according to one embodiment of the present invention.

Next, the details of the driving method of the display device of Embodiment 1 will be described with reference to FIG. 5. FIG. 5 is an example of the timing diagram showing an operation in which the signal line driver circuit 12 outputs the signal RST to the source signal lines 112 in all the groups at once, and then outputs the signal Data sequentially to the source signal lines 112 in the first to N-th groups, group by group.

Note that the potential of the signal RST is equal to that of a common electrode. When the signal RST and the common electrode are at the same potential, the number of the kinds of power source voltage can be reduced.

Note that for convenience sake, the signal Data input to the pixels 100 in the k-th group among the pixels 100 in the i-th row i.e., the pixels 100 in the i-th row and k-th group is referred to as a Data (i, k).

In each selection period, the signal line driver circuit 12 outputs the signal RST to the source signal lines 112 in all the groups at once, and then outputs the signal Data sequentially to the source signal lines 112 in the first to N-th groups, group by group. For example, in a period T0 during which the i-th row is selected, the signal line driver circuit 12 outputs the signal RST to the source signal lines 112 in all the groups at once. The signal RST is input to the pixels 100 in the i-th row.

In the next period T1 during which the i-th row is selected, the signal line driver circuit 12 outputs a Data (i, 1) to the source signal lines 112 in the first group, and stops outputting a signal to the source signal lines 112 in the second to N-th groups. Then, the potential of the source signal lines 112 in the first group becomes equal to the potential of the signal Data (i, 1), and the source signal lines 112 in the second to N-th groups become floating. Consequently, the potential of the source signal lines 112 in the second to N-th groups remains equal to the potential of the signal RST until the signal line driver circuit 12 outputs the signal Data to the source signal lines 112 in the second to N-th groups.

In the next period T2 during which the i-th row is selected, the signal line driver circuit 12 stops outputting a signal to the source signal lines 112 in the first group, and outputs a Data (i, 2) to the source signal lines 112 in the second group. Then, the source signal lines 112 in the first group become floating; the potential of the source signal lines 112 in the second group becomes equal to the potential of the signal Data (i, 2); the source signal lines 112 in the third to N-th groups remain floating. Consequently, the potential of the source signal lines 112 in the first group remains equal to that of the signal Data (i, 1). Further, the potential of the source signal lines 112 in the third to N-th groups remains equal to that of the signal RST. After that, the display device of Embodiment 1 repeats such an operation until the end of the period TN during which the i-th row is selected.

When the above-described operation is performed in each selection period, the signal Data is input to each pixel 100, and an image is displayed on the display area 10. In the display device of Embodiment 1, the signal RST and then the signal Data are input to the pixels 100. Consequently, in the display device of Embodiment 1, incorrect signal such as the signal Data or the like for the pixel 100 in the previous row can be prevented from being input to the pixel 100. In other words, an incorrect voltage can be prevented from being applied to the display elements of the pixels 100. This prevents a buildup of adverse effect due to the application of an incorrect voltage to the display elements, and thus prevents or reduces deviations in the grayscale of the display elements, reduces afterimages, and/or improves display quality.

Note that the number of groups into which the m source signal lines 112 are divided is preferably equal to the number of the color components of the display device. For example, when the display device has three color components (e.g., red, blue, and green), the m source signal lines 112 are preferably divided into three groups.

Note that when the number of groups into which the m source signal lines 112 are divided is too large, the time during which the signal line driver circuit 12 outputs the signal Data to one group is shortened. For this reason, the number of groups into which the m source signal lines 112 are divided is preferably 2 to 6, and more preferably 2 to 4. Alternatively, the number of groups into which the m source signal lines 112 are divided is preferably 20 to 40, and more preferably 25 to 35.

Note that the groups preferably have the same number of source signal lines 112. This simplifies the configuration of the signal line driver circuit 12. Note that the number of source signal lines 112 in one or some of the N groups (e.g., the first group, the N-th group, or the like) may be smaller than that of the source signal lines 112 in the other groups. This also simplifies the configuration of the signal line driver circuit 12.

Note that the periods T1 to TN preferably have the same length. This simplifies a circuit generating a signal for controlling the length of each period (e.g., a synchronization signal). Note that the length of one or some of the periods may be different from that of the other periods. For example, between two periods of the periods T1 to TN, the subsequent period is longer than the preceding period. This makes a period during which the signal Data is input to the pixel 100 longer, and thus improves display quality.

Note that the period T0 preferably has the same length as any one of the periods T1 to TN. This simplifies a circuit generating a signal for controlling the length of each period (e.g., a synchronization signal). Note that the period T0 may be longer than any one of the periods T1 to TN. This prevents more accurately an incorrect signal from being input to the display elements. Alternatively, the period T0 may be shorter than any one of the periods T1 to TN. This shortens a selection period.

Note that the value of the signal RST is preferably set such that the absolute value of a difference between the potential of the signal RST and that of the common electrode is lower than the absolute value of the threshold voltage of the display elements. Specifically, the signal RST preferably has the same potential as the common electrode. This reduces the number of the kinds of power source voltage. Note that the potential of the signal RST may be different from that of the common electrode, in view of switching noise in the source signal lines 112 or the like. For example, suppose that the signal line driver circuit 12 controls the timing of outputting the signal RST to the source signal lines 112 by using n-channel transistors. In this case, the n-channel transistors are turned on, and turned off after the signal RST is output to the source signal lines 112, thereby making the potential of the source signal lines 112 lower than that of the signal RST. The potential of the signal RST may be higher than that of the common electrode, in view of such a reduction in the potential of the source signal lines 112. Note that for the same reason, in the case where the signal line driver circuit 12 controls the timing of outputting the signal RST to the source signal lines 112 by using p-channel transistors, the potential of the signal RST may be lower than that of the common electrode.

According to the above description, in the period during which the i-th row is selected, the signal line driver circuit 12 outputs the signal Data (i, k) to the source signal lines 112 in the k-th group. This description does not mean that the signal line driver circuit outputs the same signal to all of the source signal lines 112 in the k-th group when the k-th group has two or more source signal lines 112. When the k-th group has two or more source signal lines 112, the signal line driver circuit 12 can output different signals or the same signal to the source signal lines 112 in the k-th group in accordance with the grayscale of the pixels 100 electrically connected to the source signal lines 112 in the k-th group.

Note that as shown in the timing diagram of FIG. 4, when a certain period is set between the end of a selection period during which a certain row is selected and the start of a selection period during which the subsequent row is selected, the signal line driver circuit 12 may output the signal RST before the start of the selection period during which the certain row is selected and after the end of a period during which the preceding row is selected. This makes the time during which the signal line driver circuit 12 outputs the signal Data to one group of source signal lines 112 longer. Alternatively, this prevents an incorrect signal (e.g., the signal Data for the preceding row) from being input to the pixels 100 because of deviations in the timing or the like before the signal RST is input thereto.

Embodiment 1 can be combined with any of the other embodiments as appropriate.

Embodiment 2

In Embodiment 1, the driving method of a display device that is different from Embodiment 1 will be described. In Embodiment 2, only points different from Embodiment 1 will be described and the description of the same points as those in Embodiment 1 will be omitted.

The driving method of the display device of Embodiment 2 is different from that of the display device of Embodiment 1 in that the signal line driver circuit 12 outputs the signal Data to the source signal lines 112 in one group and the signal RST to the source signal lines 112 in the other groups in each selection period.

Figure 6:
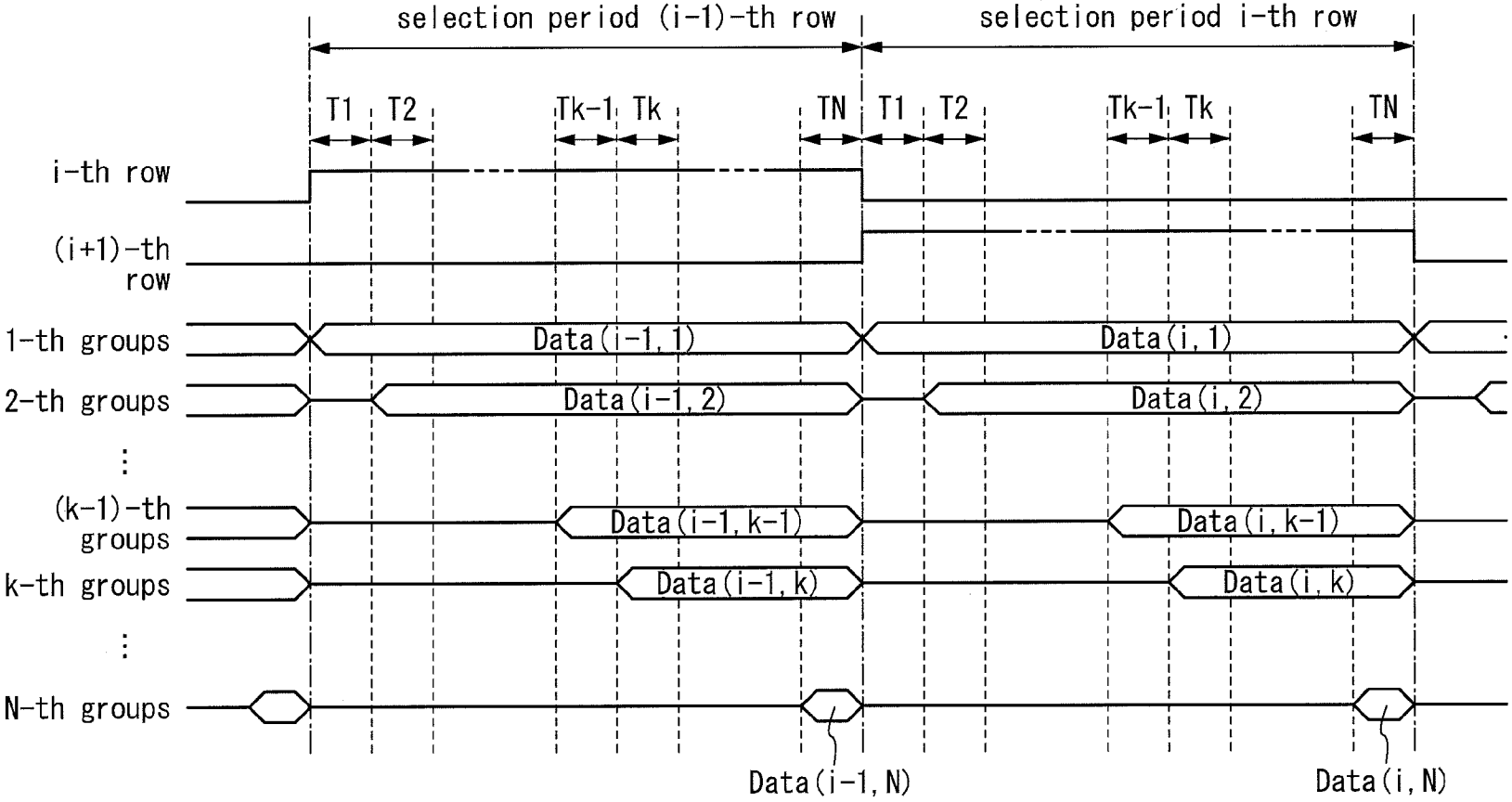
FIG. 6 is a diagram illustrating the display device according to one embodiment of the present invention.

FIG. 6 is an example of the timing diagram for describing the driving method of the display device of Embodiment 2. Each selection period is divided into a plurality of periods, the periods T1 to TN. In the timing diagram of FIG. 6, in each selection period, the signal line driver circuit 12 outputs the signal Data to the source signal lines 112 in the first group and the signal RST to the source signal lines 112 in the second to N-th groups. Then, the signal line driver circuit 12 outputs, row by row, the signal Data sequentially to the source signal lines 112 in the second to N-th groups as in the driving method of the display device of Embodiment 1.

For example, in the period T1 during which the i-th row is selected, the signal line driver circuit 12 outputs the signal Data (i, 1) to the source signal lines 112 in the first group and the signal RST to the source signal lines 112 in the second to N-th groups.

In the next period T2 during which the i-th row is selected, the signal line driver circuit 12 stops outputting a signal to the source signal lines 112 in the first group, outputs the signal Data (i, 2) to the source signal lines 112 in the second group, and stops outputting a signal to the source signal lines 112 in the third to N-th groups. Then, the source signal lines 112 in the first group become floating. Consequently, the potential of the source signal lines 112 in the first group remains equal to that of the signal Data (i, 1). Further, the source signal lines 112 in the third to N-th groups become floating. Consequently, the potential of the source signal lines 112 in the third to N-th groups remains equal to the potential of the signal RST until the signal line driver circuit 12 outputs the signal Data to the source signal lines 112 in the third to N-th groups.

In the next period T3 during which the i-th row is selected, the signal line driver circuit 12 stops outputting a signal to the source signal lines 112 in the second group, and outputs a Data (i, 3) to the source signal lines 112 in the third group. Then, the source signal lines 112 in the second group become floating. Consequently, the potential of the source signal lines 112 in the second group remains equal to that of the signal Data (i, 2). Here, the signal line driver circuit 12 still does not output a signal to the source signal lines 112 in the first group and the fourth to N-th groups. After that, the display device of Embodiment 2 repeats such an operation until the end of the period TN during which the i-th row is selected.

When the above-described operation is performed in each selection period, the signal Data is input to each pixel 100, and an image is displayed on the display area 10. In the display device of Embodiment 1, the signal RST and then the signal Data are input to the pixels 100. Consequently, in the display device of Embodiment 1, incorrect signal such as the signal Data or the like for the pixel 100 in the previous row can be prevented from being input to the pixel 100. In other words, an incorrect voltage can be prevented from being applied to the display elements of the pixels 100. This prevents a buildup of adverse effect due to the application of an incorrect voltage to the display elements, and thus prevents or reduces deviations in the grayscale of the display elements, reduces afterimages, and/or improves display quality.

In addition, in the display device of Embodiment 2, the number into which a selection period is divided can be reduced. This makes each of the periods T1 to TN longer. In other words, the time during which the signal line driver circuit 12 outputs a signal to one group of source signal lines 112 can be made longer, thereby increasing the display area and improving the display quality. Alternatively, this makes the selection period shorter, and thus increases the number of pixels arranged in the display area 10.

Embodiment 2 can be combined with any of the other embodiments as appropriate.

Embodiment 3

In Embodiment 3, a specific example of the signal line driver circuit of a display device that is one embodiment of the present invention and the driving method thereof will be described.

First, a structural example of the signal line driver circuit of Embodiment 3 will be described below with reference to FIG. 7.

Figure 7:
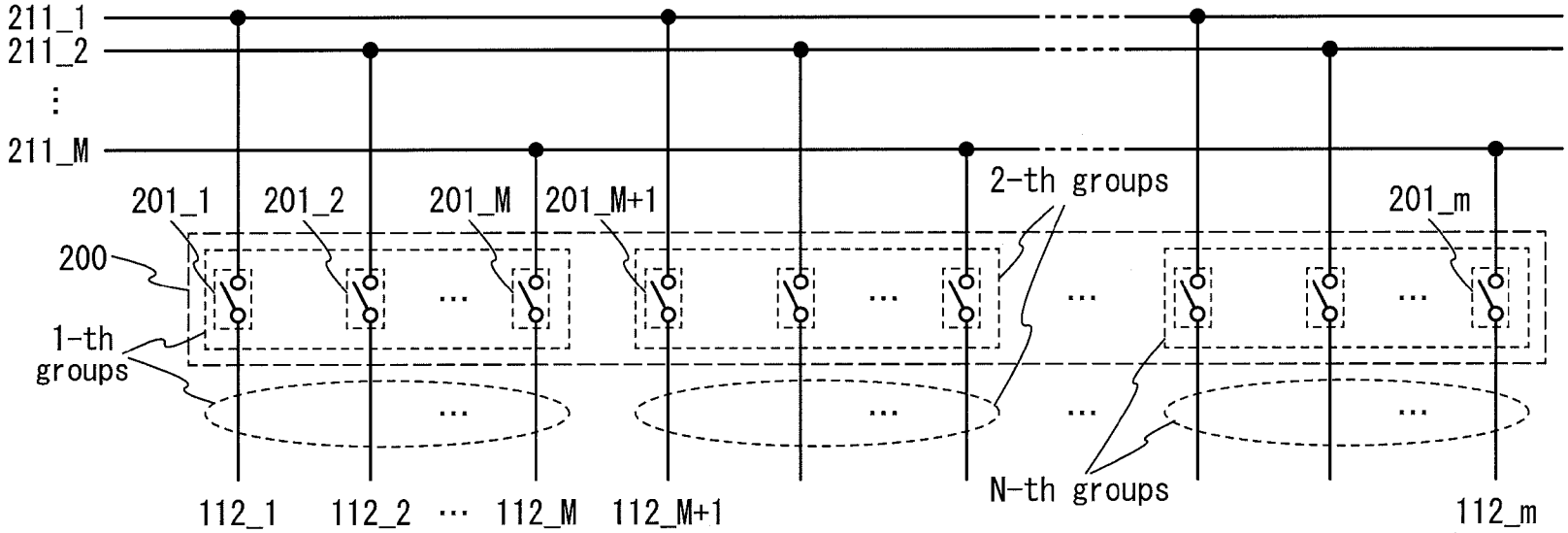
FIG. 7 is a diagram illustrating the display device according to one embodiment of the present invention.

The signal line driver circuit shown in FIG. 7 includes a demultiplexer circuit 200. The demultiplexer circuit 200 includes m switches 201 (referred to as switches 201_1 to 201_*m*). The m switches 201 are divided into N groups. Each group includes M (M is a natural number) switches 201. The demultiplexer circuit 200 is electrically connected to M image signal lines 211 (referred to as image signal lines 211_1 to 211_M) and to m source signal lines 112. The switch 201 is electrically connected between the image signal line 211 and the source signal line 112. For example, the j-th switch 201 is electrically connected between any one of the M image signal lines 211 and the j-th source signal line 112. Note that the image signal lines 211 are wirings for transmitting an image signal, and are also called wirings, signal lines or video signal lines.

The demultiplexer circuit 200 has a function of allocating an image signal transmitted by the image signal lines 211 to two or more source signal lines, and is also called a driver circuit, selector circuit, SSD circuit, or signal line driver circuit. The timing of allocating an image signal is controlled by controlling the conduction state of the switch 201. When the switch 201 is turned on, an electrical continuity is established between the image signal line 211 and the source signal line 112. Consequently, an image signal is output to the source signal line 112. In contrast, when the switch 201 is turned off, an electrical continuity between the image signal line 211 and the source signal line 112 is broken. Consequently, an image signal is not output to the source signal line 112.

Figure 8:
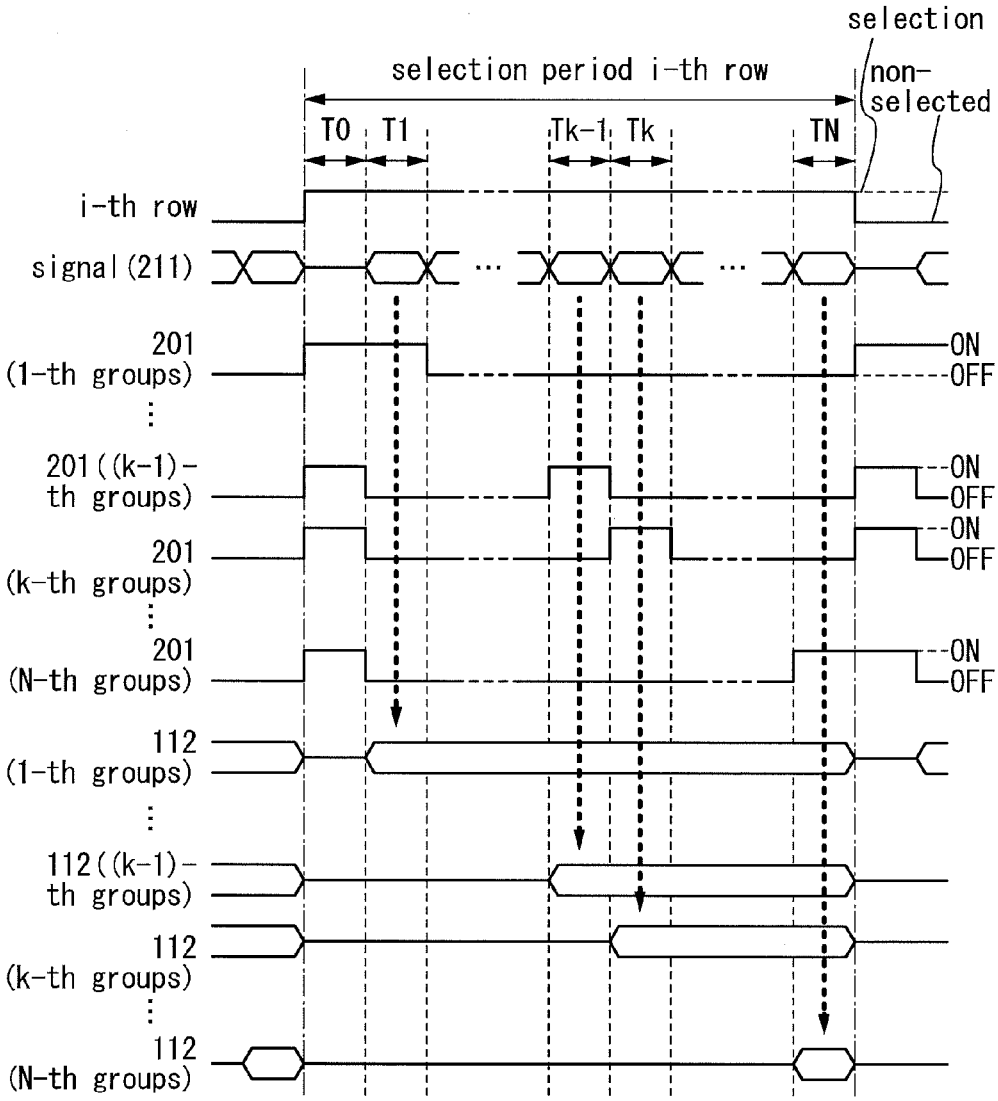
FIG. 8 is a diagram illustrating the display device according to one embodiment of the present invention.

Next, an example of the driving method of the signal line driver circuit shown in FIG. 7 will be described with reference to FIG. 8. FIG. 8 is an example of the timing diagram showing the driving method of the display device of Embodiment 1.

In each selection period, the switches 201 in all the groups are turned on at once, and the signal RST is output to the source signal lines 112 in all the groups at once. Then, the switches 201 in the first to N-th groups are sequentially turned on group by group, so that the signal Data is sequentially output to the source signal lines 112 in the first to N-th groups, group by group. For example, in the period T0 during which the i-th row is selected, the switches 201 in all the groups are turned on at once. In the period T0, the signal RST is input to the image signal line 211. Consequently, the signal RST is output to the source signal lines 112 in all the groups at once.

Then, in the period T1 during which the i-th row is selected, the switches 201 in the first group remain on, and the switches 201 in the second to N-th groups are turned off. In the period T1, the signal Data (i, 1) is input to the image signal lines 211. Consequently, the signal Data (i, 1) is output to the source signal lines 112 in the first group.

Then, in the period T2 during which the i-th row is selected, the switches 201 in the first group are turned off; the switches 201 in the second group are turned on; the switches 201 in the third to N-th groups remain off. In the period T2, the signal Data (i, 2) is input to the image signal lines 211. Consequently, the signal Data (i, 2) is output to the image signal lines 211 in the second group. After that, the demultiplexer circuit 200 repeats the same operation as that performed in the periods T1 and T2, until the end of the period TN.

When the above-described operation is performed in each selection period, the signal Data is input to each pixel 100, and an image is displayed on the display area 10. In the display device of Embodiment 1, the signal RST and then the signal Data are input to the pixels 100. Consequently, in the display device of Embodiment 1, incorrect signal such as the signal Data or the like for the pixel 100 in the previous row can be prevented from being input to the pixel 100. In other words, an incorrect voltage can be prevented from being applied to the display elements of the pixels 100. This prevents a buildup of adverse effect due to the application of an incorrect voltage to the display elements, and thus prevents or reduces deviations in the grayscale of the display elements, reduces afterimages, and/or improves display quality.

Note that the signal line driver circuit shown in FIG. 7 has a relatively low frequency. For this reason, transistors using amorphous silicon, microcrystalline silicon, an oxide semiconductor, or the like can be used as the switches 201. When the switches 201 are such transistors, it is possible to achieve a reduction in manufacturing cost, an increase in the size of the display device, improvement in yield, improvement in reliability, or the like.

Note that when the signal line driver circuit shown in FIG. 7 is formed using transistors using amorphous silicon, microcrystalline silicon, an oxide semiconductor, or the like, the signal line driver circuit and the display area are preferably formed over the same substrate. This reduces the number of connection points between an external circuit and the substrate over which the display area is formed, and thus achieves improvement in yield, improvement in reliability, a reduction in cost, or the like.

Note that the switches 201 in the two or more of groups may be turned on at once.

Note that the switches 201 in the first to N-th groups may be turned on group by group in a predetermined order. In this case, the conduction state of the switches 201 is preferably controlled by a decoder circuit.

Embodiment 3 can be combined with any of the other embodiments as appropriate.

Embodiment 4

In Embodiment 4, a specific example of the signal line driver circuit that is different from Embodiment 3 and the driving method thereof will be described. In Embodiment 4, only points different from Embodiment 3 will be described and the description of the same points as those in Embodiment 3 will be omitted.

First, a structural example of the signal line driver circuit of Embodiment 4 will be described below with reference to FIG. 9.

The signal line driver circuit of Embodiment 4 is different from that of Embodiment 3 in having m switches 202 (referred to as switches 202_1 to **202_*m*). Like the switches 201, the m switches 202 are divided into N groups. Each group has M the switches 202. The switches 202 are electrically connected between a power supply line 212 and the source signal line 112. For example, the j-th switch 202 is electrically connected between the power supply line 212 and the j-th source signal line 112. Note that the power supply line 212** is a wiring for transmitting the signal RST, and is also called a wiring or a signal line.

Figure 10:
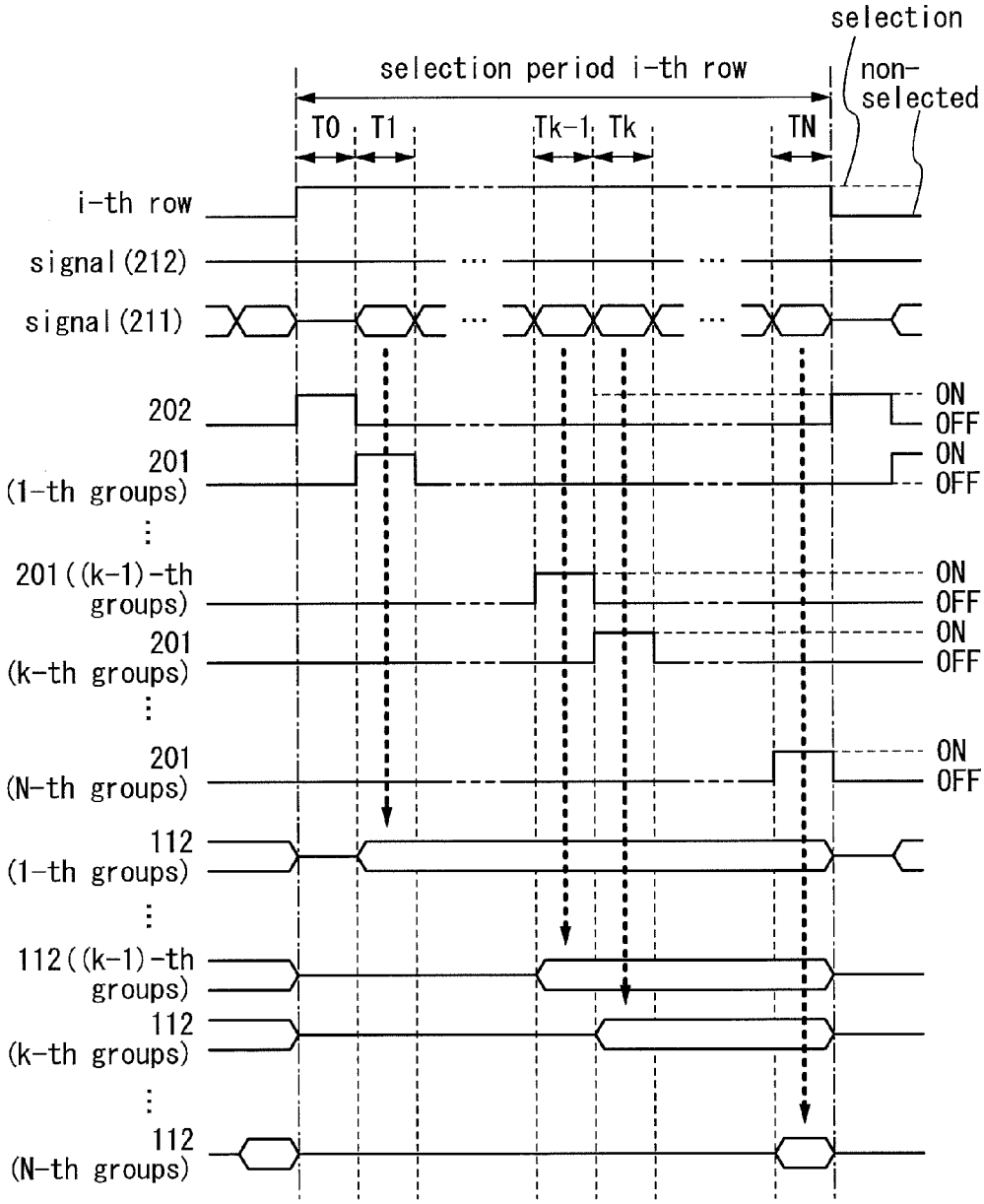
FIG. 10 is a diagram illustrating the display device according to one embodiment of the present invention.

Next, an example of the driving method of the signal line driver circuit of Embodiment 4 will be described with reference to FIG. 10. FIG. 10 is an example of the timing diagram showing the driving method of the display device of Embodiment 1.

In each selection period, the switches 201 in all the groups are turned off; the switches 202 in all the groups are turned on; the signal RST is output to the source signal lines 112 in all the groups at once. Then, the switches 202 in all the groups are turned off, and the switches 201 in the first to N-th groups are sequentially turned on group by group, so that the signal Data is sequentially output to the source signal lines 112 in the first to N-th groups, group by group. For example, in the period T0 during which the i-th row is selected, the switches 201 in all the groups are turned off, and the switches 202 in all the groups are turned on. Consequently, the signal RST is output to the source signal lines 112 in all the groups at once.

Then, in the period T1 during which the i-th row is selected, the switches 202 in all the groups are turned off; the switches 201 in the first group are turned on; the switches 201 in the second to N-th groups are turned off. Consequently, the signal Data (i, 1) is output to the source signal lines 112 in the first group.

In the next period T2 during which the i-th row is selected, the switches 202 in all the groups remain off; the switches 201 in the first group are turned off; the switches 201 in the second group are turned on; the switches 201 in the third to N-th groups remain off. Consequently, the signal Data (i, 2) is output to the image signal lines 112 in the second group. After that, the demultiplexer circuit 200 repeats the same operation as that performed in the periods T1 and T2, until the end of the period TN.

When the above-described operation is performed in each selection period, the signal Data is input to each pixel 100, and an image is displayed on the display area 10. In the display device of Embodiment 1, the signal RST and then the signal Data are input to the pixels 100. Consequently, in the display device of Embodiment 1, incorrect signal such as the signal Data or the like for the pixel 100 in the previous row can be prevented from being input to the pixel 100. In other words, an incorrect voltage can be prevented from being applied to the display elements of the pixels 100. This prevents a buildup of adverse effect due to the application of an incorrect voltage to the display elements, and thus prevents or reduces deviations in the grayscale of the display elements, reduces afterimages, and/or improves display quality.

Embodiment 4 can be combined with any of the other embodiments as appropriate.

Embodiment 5

In Embodiment 5, a specific example of the signal line driver circuit that is different from Embodiment 3 and Embodiment 4 and the driving method thereof will be described. In Embodiment 5, only points different from Embodiment 4 will be described and the description of the same points as those in Embodiment 4 will be omitted.

First, a structural example of the signal line driver circuit of Embodiment 5 will be described below with reference to FIG. 11.

The signal line driver circuit of Embodiment 5 is different from that of Embodiment 4 in that the switches 202 in the first group are omitted.

Figure 12:
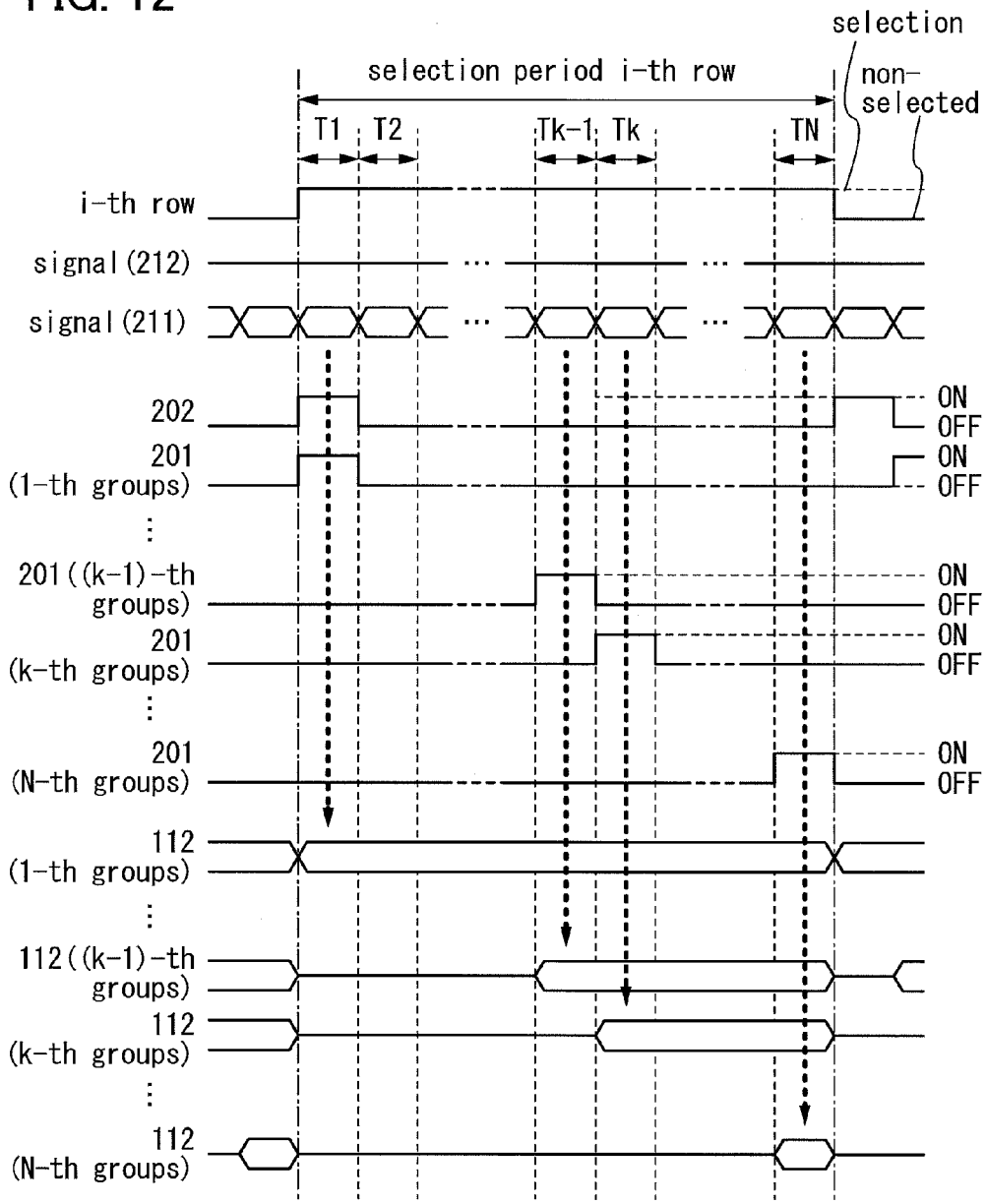
FIG. 12 is a diagram illustrating the display device according to one embodiment of the present invention.

Next, an example of the driving method of the signal line driver circuit of Embodiment 5 will be described with reference to FIG. 12. FIG. 12 is an example of the timing diagram showing the driving method of the display device of Embodiment 2.

In each selection period, the switches 201 in the first group are turned on; the switches 201 in the second to N-th groups are turned off; the switches 202 in the second to N-th groups are turned on. Then, the signal Data is output to the source signal lines 112 in the first group, and the signal RST is output to the source signal lines 112 in the second to N-th groups. In the next step, the switches 201 in the first group are turned off; the switches 201 in the second to N-th groups are sequentially turned on group by group; the switches 202 in the second to N-th groups are turned off. Then, the signal Data is output sequentially to the source signal lines 112 in the second to N-th groups, group by group. For example, in the period T1 during which the i-th row is selected, the switches 201 in the first group are turned on; the switches 201 in the second to N-th groups are turned off; the switches 202 in the second to N-th groups are turned on. Consequently, the signal Data (i, 1) is output to the source signal lines 112 in the first group, and the signal RST is output to the source signal lines 112 in the second to N-th groups.

Then, in the period T2 during which the i-th row is selected, the switches 201 in the first group are turned off; the switches 201 in the second group are turned on; the switches 201 in the third to N-th groups remain off; the switches 202 in the second to N-th groups are turned off. Consequently, the signal Data (i, 2) from the image signal lines 211 is output to the source signal lines 112 in the second group.

Then, in the period T3 during which the i-th row is selected, the switches 201 in the first group remain off; the switches 201 in the second group are turned off; the switches 201 in the third group are turned on; the switches 201 in the fourth to N-th groups remain off; the switches 202 in the second to N-th groups remain off. Consequently, the signal Data (i, 3) from the image signal lines 211 is output to the source signal lines 112 in the third group. After that, the demultiplexer circuit 200 repeats the same operation as that performed in the periods T2 and T3, until the end of the period TN.

When the above-described operation is performed in each selection period, the signal Data is input to each pixel 100, and an image is displayed on the display area 10. In the display device of Embodiment 1, the signal RST and then the signal Data are input to the pixels 100. Consequently, in the display device of Embodiment 1, incorrect signal such as the signal Data or the like for the pixel 100 in the previous row can be prevented from being input to the pixel 100. In other words, an incorrect voltage can be prevented from being applied to the display elements of the pixels 100. This prevents a buildup of adverse effect due to the application of an incorrect voltage to the display elements, and thus prevents or reduces deviations in the grayscale of the display elements, reduces afterimages, and/or improves display quality.

Embodiment 5 can be combined with any of the other embodiments as appropriate.

Embodiment 6

In Embodiment 6, the case where transistors are used as switches in the signal line driver circuit of Embodiments 3 to 5 will be described.

Figure 13:
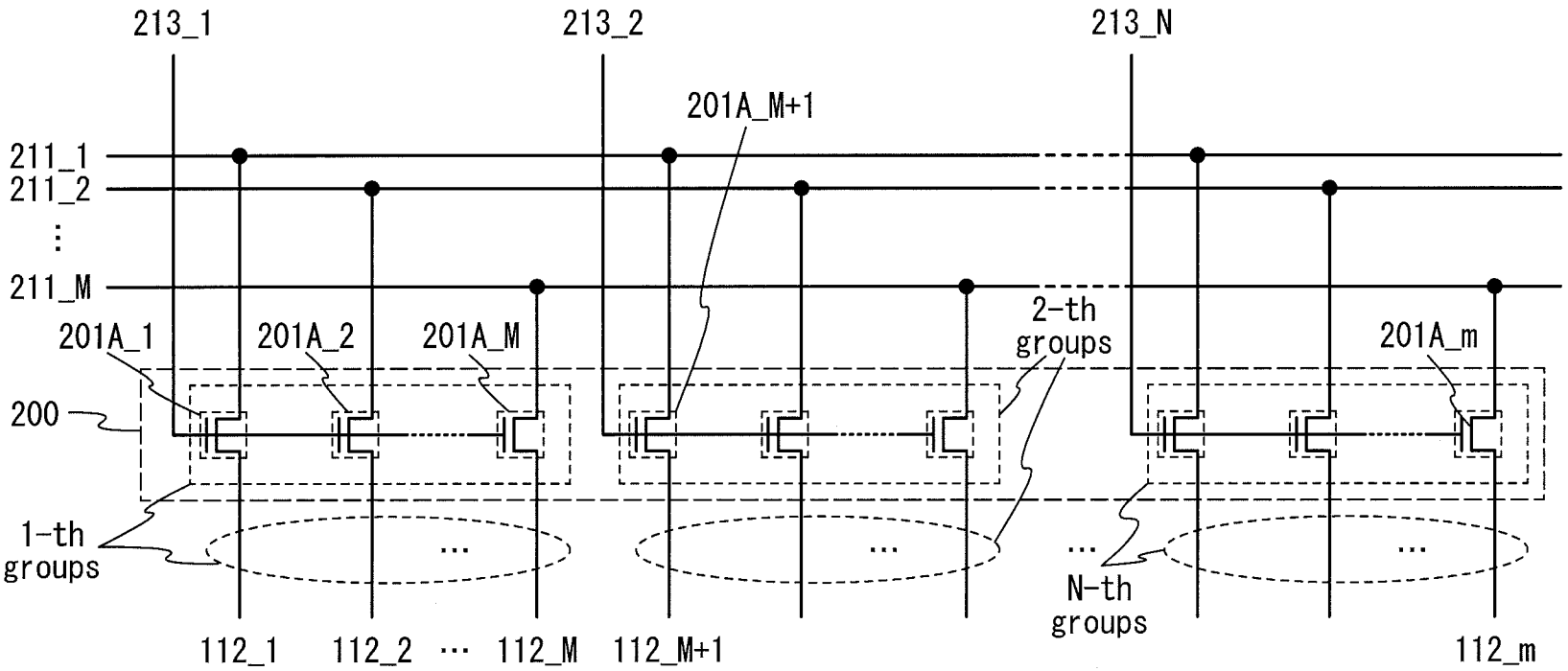
FIG. 13 is a diagram illustrating the display device according to one embodiment of the present invention.

FIG. 13 shows an example of the case where transistors are used as the switches in the signal line driver circuit shown in FIG. 7. In FIG. 13, transistors 201A are used as the switches 201. A first terminal (one of a source and a drain) of the transistor 201A is electrically connected to the image signal line 211. A second terminal (the other of the source and the drain) of the transistor 201A is electrically connected to the source signal line 112. A gate of the transistor 201A is electrically connected to a wiring 213. Specifically, the first terminal (one of the source and the drain) of each of the transistors 201A in the k-th group is electrically connected to any one of the image signal lines 211_1 to 211_M. The second terminal (the other of the source and the drain) of each of the transistors 201A in the k-th group is electrically connected to the image signal line 211_*k*. The gate of each of the transistors 201A in the k-th group is electrically connected to the k-th wiring 213 (referred to as the wiring 213_*k*).

Note that a transistor may be either an n-channel transistor or p-channel transistor. An n-channel transistor turns on when a potential difference (also referred to as Vgs) between the gate and the source exceeds the threshold voltage. A p-channel transistor turns on when Vgs falls below the threshold voltage.

Figure 14:
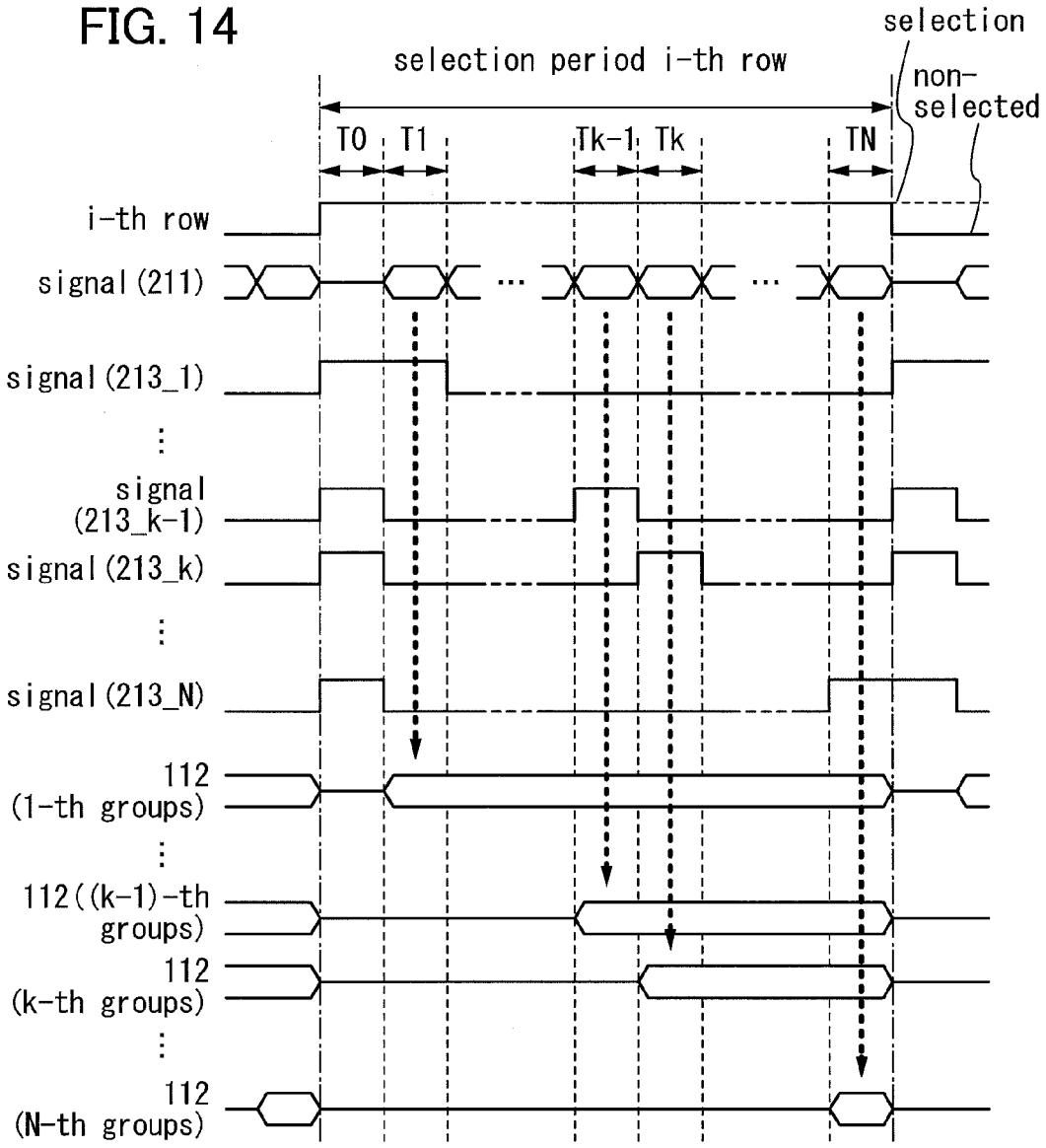
FIG. 14 is a diagram illustrating the display device according to one embodiment of the present invention.

FIG. 14 is an example of the timing diagram for describing the driving method of the signal line driver circuit shown in FIG. 13. The timing diagram of FIG. 14 shows an example of the case where the transistors are n-channel transistors. In a period during which the switches 201 in one group are turned on, a high-level signal is input to the wiring 213 electrically connected to the gates of the transistors 201A in that group. In contrast, in a period during which the switches 201 in one group are turned off, a low-level signal is input to the wiring 213 electrically connected to the gates of the transistors 201A in that group. For example, in a period Tk, the switches 201 in the k-th group are turned on, and the switches 201 in the first to (k−1)-th groups and the (k+1)-th to N-th groups are turned off. Consequently, a high-level signal is input to the k-th wiring 213, and a low-level signal is input to the first to (k−1)-th wirings 213 and the (k+1)-th and N-th wirings 213.

Figure 9:
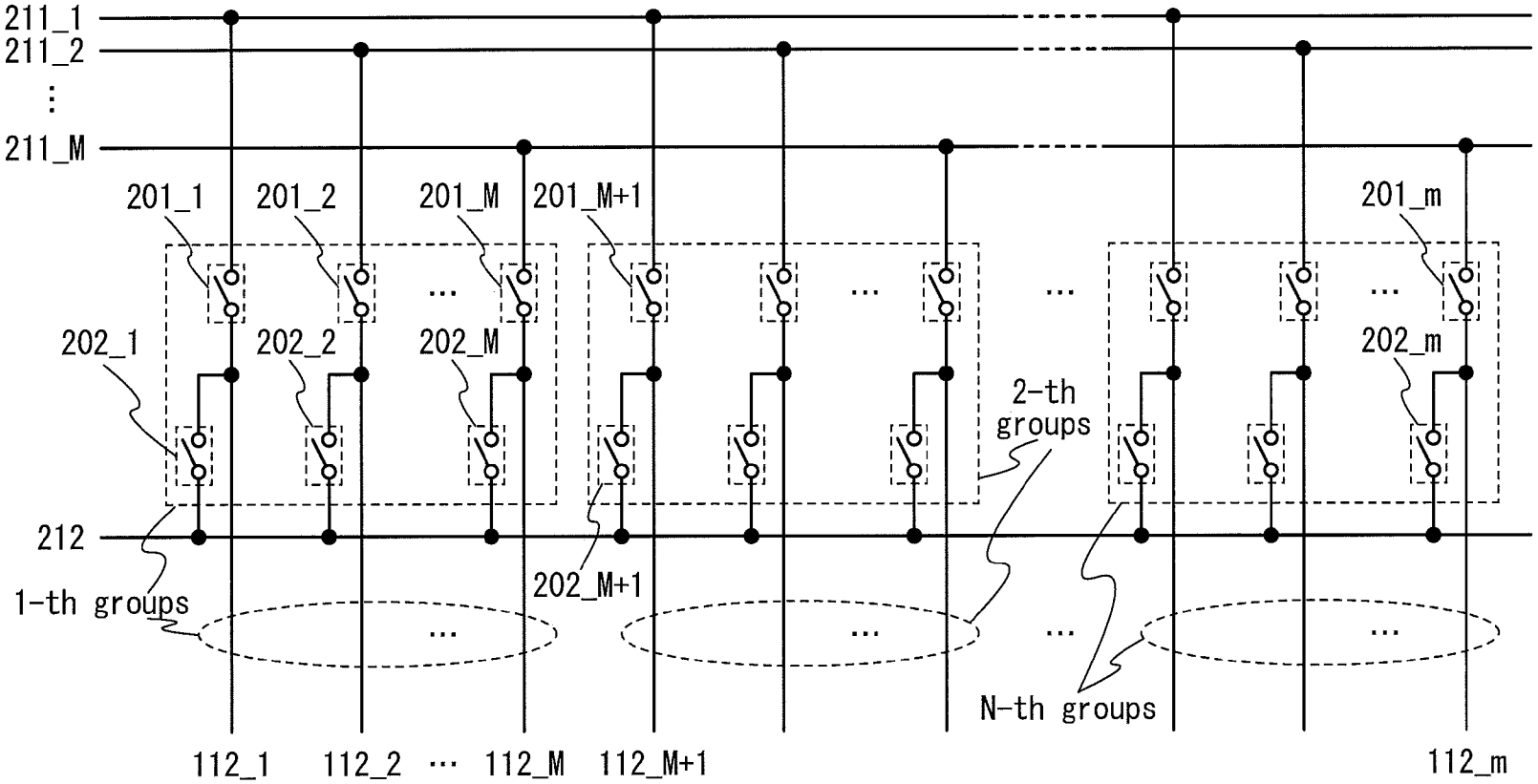
FIG. 9 is a diagram illustrating the display device according to one embodiment of the present invention.
Figure 15:
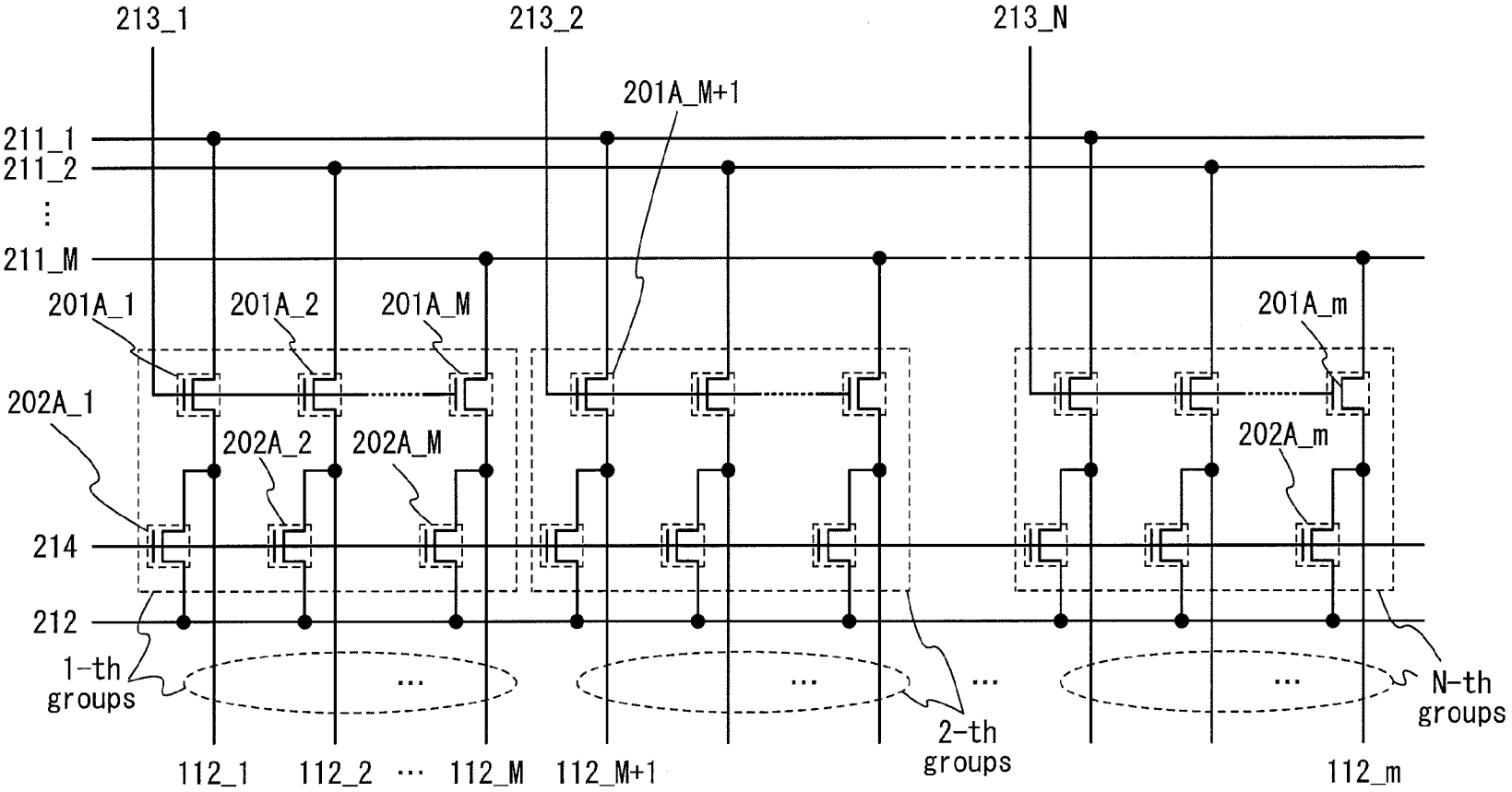
FIG. 15 is a diagram illustrating the display device according to one embodiment of the present invention.

FIG. 15 shows an example of the circuit diagram in which transistors are used as the switches in the signal line driver circuit shown in FIG. 9. In FIG. 15, transistors 202A are used as the switches 202. A first terminal of the transistor 202A is electrically connected to the power supply line 212. A second terminal of the transistor 202A is electrically connected to the source signal line 112. A gate of the transistor 202A is electrically connected to a wiring 214. Specifically, the first terminal of the j-th transistor 202A is electrically connected to the j-th power supply line 212. The second terminal of the j-th transistor 202A is electrically connected to the source signal line 112. The gate of the j-th transistor 202A is electrically connected to the wiring 214.

Figure 11:
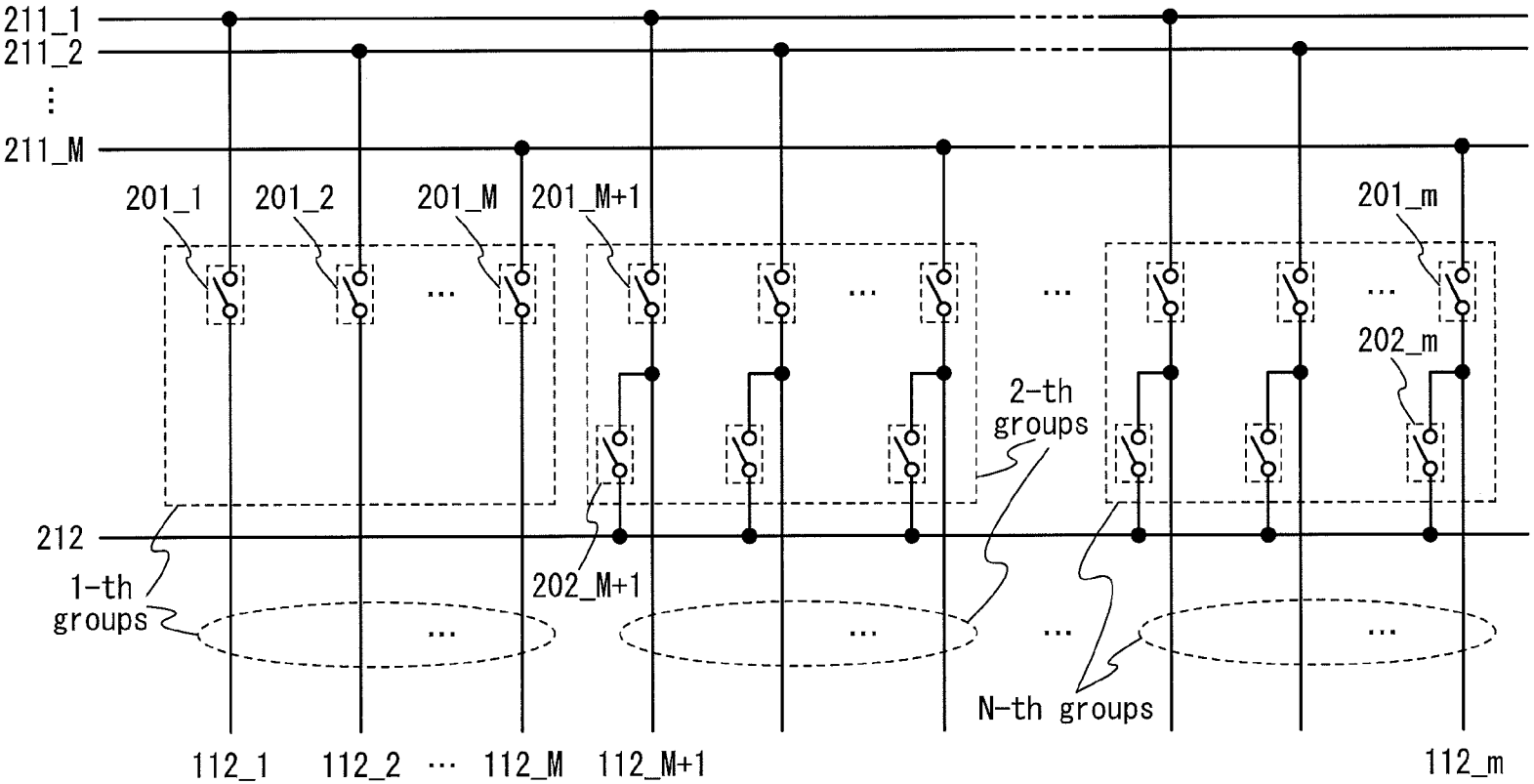
FIG. 11 is a diagram illustrating the display device according to one embodiment of the present invention.

Note that if transistors are used as the switches in the signal line driver circuit in FIG. 11, the configuration of the signal line driver circuit is the same as that of the signal line driver circuit in FIG. 15 except that the transistors 202A in the first group are omitted.

Figure 16:
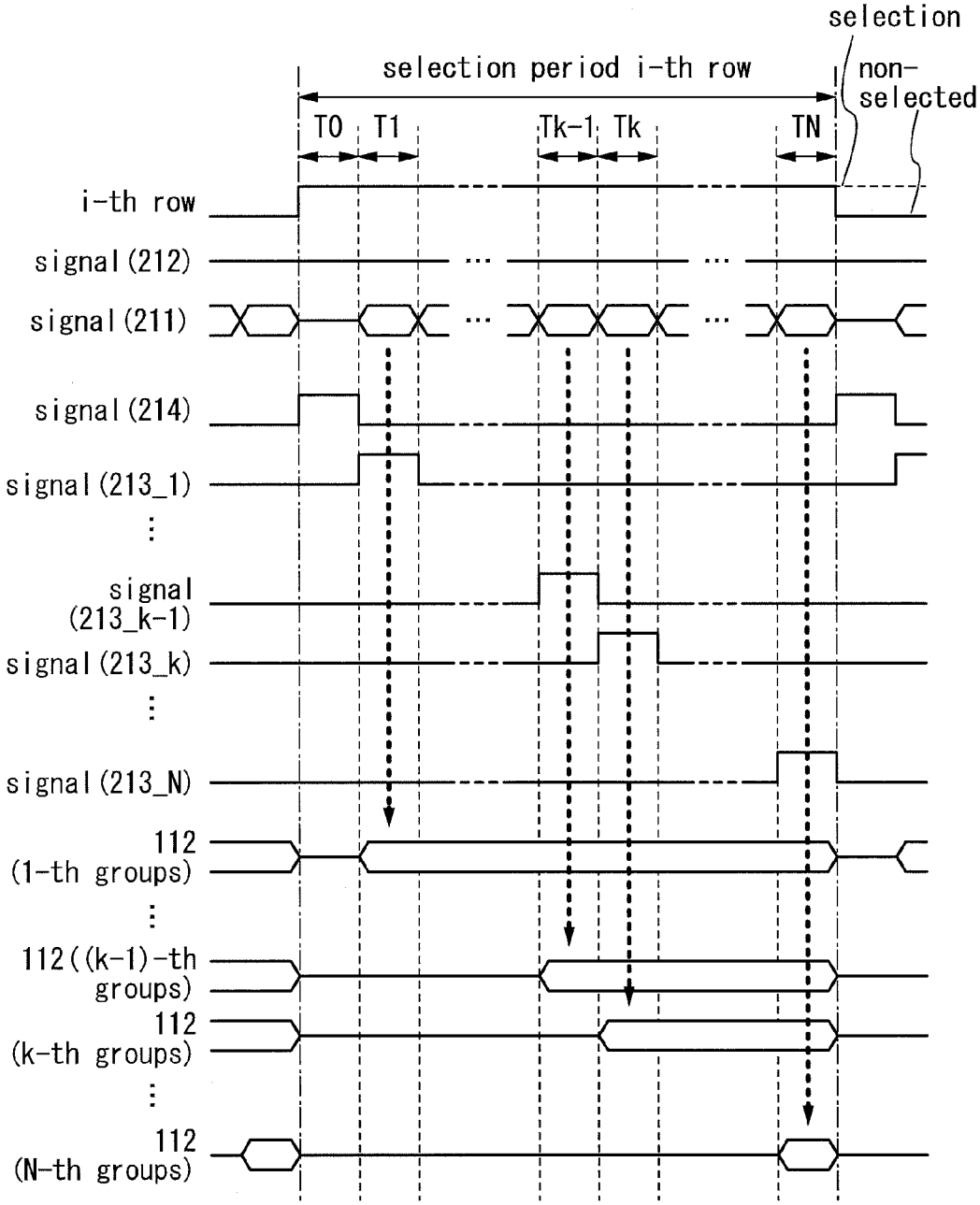
FIG. 16 is a diagram illustrating the display device according to one embodiment of the present invention.

FIG. 16 is an example of the timing diagram for describing the driving method of the signal line driver circuit shown in FIG. 15. The timing diagram of FIG. 16 shows an example of the case where the transistors are n-channel transistors. In a period during which the switches 202 are turned on (e.g., the period T0), a high-level signal is input to the wiring 214. In contrast, in a period during which the switches 202 are turned off (e.g., the periods T1 to TN), a low-level signal is input to the wiring 214.

Note that the W/L ratio of the m transistors 201A (W is the channel width and L is the channel length) is preferably the same. Alternatively, the transistors 201A in each group preferably have the same W/L ratio. This allows the source signal lines 112 to have the same amount of switching noise, thereby improving display quality.

Note that the W/L ratio of the transistor 202A is preferably higher than that of the transistor 201A. This shortens the time required for the potential of the source signal line 112 to reach the potential of the signal RST. Consequently, it is possible to shorten the time during which an incorrect voltage is applied to the display element of the pixel 100, and thus improve display quality.

Note that the W/L ratio of the transistor 201A and the W/L ratio of the transistor 202A are preferably higher than that of the transistor in the pixel 100.

Note the amplitude voltage of a signal input to the wirings 213 and that of a signal input to the wiring 214 are preferably the same. This reduces the number of the kinds of power source voltages in a circuit for supplying a signal to the wirings 213 and the wiring 214. Note that the amplitude voltage of a signal input to the wiring 214 may be lower than that of a signal input to the wirings 213.

Note that when the signal line driver circuit of Embodiment 6 outputs the signal Data sequentially to the source signal lines 112 in the first to N-th groups, group by group, the wirings 213 are preferably electrically connected to the shift register circuit. In contrast, when the signal line driver circuit of Embodiment 6 outputs the signal Data to the source signal lines 112 in the first to N-th groups in a predetermined order, the wirings 213 are preferably electrically connected to the decoder circuit.

Note that when the shift register circuit or the decoder circuit is electrically connected to the wirings 213, these circuits may be formed over the same substrate as the signal line driver circuit and the display area. This reduces the number of connection points between an external circuit and the substrate over which the display area is formed, and thus achieves improvement in yield, improvement in reliability, a reduction in cost, or the like. Note that a circuit such as a shift register circuit or a decoder circuit may be formed over a substrate different from that over which the signal line driver circuit and the display area are formed. This allows the circuit, such as a shift register circuit or a decoder circuit, to be formed using transistors using single crystal silicon, and thus reduces power consumption.

Note that when p-channel transistors are used as the switches, the polarity of the potentials in each timing diagram is inverted.

Note that in the case where transistors are used in a signal line driver circuit as in the signal line driver circuit of Embodiment 6, the signal line driver circuit can be called a semiconductor device.

Embodiment 6 can be combined with any of the other embodiments as appropriate.

Embodiment 7

In Embodiment 7, a specific example of the pixel in the display device that is one embodiment of the present invention and the driving method thereof will be described.

Figure 17A:
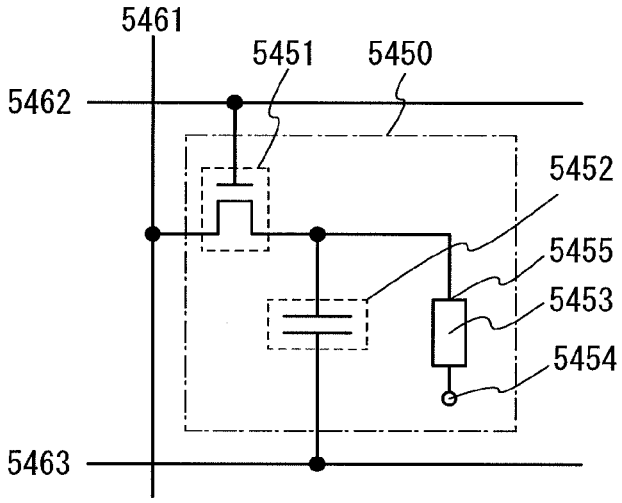
FIGS. 17A and 17B are diagrams illustrating the display device according to one embodiment of the present invention.

FIG. 17A is a circuit diagram of a pixel. A pixel 5450 includes a transistor 5451, a capacitor 5452, and a display element 5453. The display element 5453 is sandwiched between a pixel electrode 5455 and a common electrode 5454. A first terminal of the transistor 5451 is electrically connected to a source signal line 5461. A second terminal of the transistor 5451 is electrically connected to one electrode of the capacitor 5452 and the pixel electrode 5455. A gate of the transistor 5451 is electrically connected to a gate signal line 5462. The other electrode of the capacitor 5452 is electrically connected to a wiring 5463.

Note that the source signal line 5461 corresponds to the source signal line 112 shown in FIG. 1, and the gate signal line 5462 corresponds to the gate signal line 111 shown in FIG. 1.

The transistor 5451 has a function of controlling the timing of inputting an image signal, which is to be input to the source signal line 5461, to the pixel 5450, and is also called a selection transistor or switching transistor. The capacitor 5452 has a function of holding a voltage or charge based on an image signal input to the pixel 5450, and is also called a storage capacitor.

The display element 5453 has memory properties. Examples of a display element having memory properties or the driving method thereof are the microcapsule electrophoretic method, microcup electrophoretic method, horizontal electrophoretic method, vertical electrophoretic method, twisting ball method, liquid powder method, electronic liquid powder (registered trademark) method, cholesteric liquid crystal element, chiral nematic liquid crystal element, antiferroelectric liquid crystal element, polymer dispersed liquid crystal element, charged toner, electrowetting method, electrochromism method, and electrodeposition method.

Note that a display device using the electrophoretic method such as the microcapsule electrophoretic method, the microcup electrophoretic method, the horizontal electrophoretic method, or the vertical electrophoretic method as the driving method of the display element 5453 may be called an electrophoretic display device. In addition, a display device using a liquid crystal element such as a cholesteric liquid crystal element, a chiral nematic liquid crystal element, an antiferroelectric liquid crystal element, or a polymer dispersed liquid crystal element may be called a liquid crystal display device.

Figure 17B:
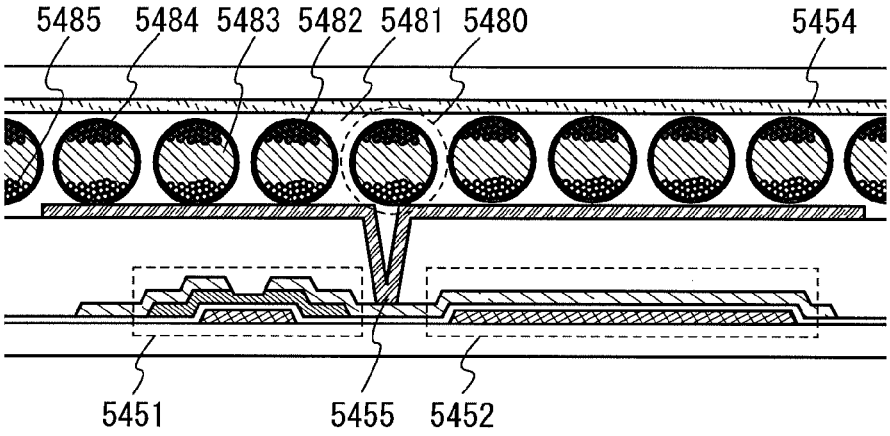

FIG. 17B is a cross-sectional view of a pixel using the microcapsule electrophoretic method. A plurality of microcapsules 5480 are placed between a common electrode 5454 and a pixel electrode 5455. The plurality of microcapsules 5480 are fixed by a resin 5481. The resin 5481 functions as a binder. The resin 5481 preferably has light-transmitting properties. A space formed by the common electrode 5454, the pixel electrode 5455, and the microcapsule 5480 can be filled with a gas such as air or an inert gas. In such a case, a layer containing glue, adhesive, or the like is preferably formed on one or both of the common electrode 5454 and the pixel electrode 5455 to fix the microcapsules 5480. At least two kinds of particles composed of pigments are included in a film 5482. The particles of one kind preferably have a different color from the particles of the other kind. For example, a microcapsule includes particles composed of a black pigment 5484 and particles composed of a white pigment 5485.

Figure 18A:
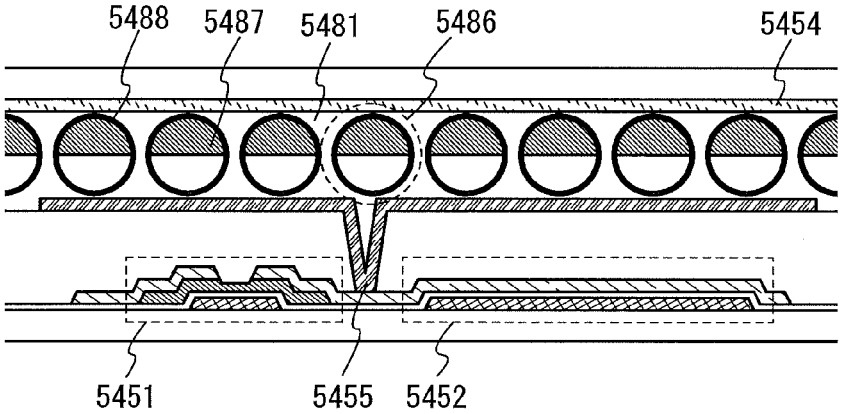
FIGS. 18A to 18C are diagrams each illustrating the display device according to one embodiment of the present invention.

FIG. 18A is a cross-sectional view of a pixel including the display element 5453 using a twisting ball method. In the twisting ball method, the reflectance is changed by rotation of a display element in order to control the gray level. FIG. 18A is different from FIG. 17B in that twisting balls 5486 are placed between the common electrode 5454 and the pixel electrode 5455. The twisting ball 5486 includes a particle 5487 and a cavity 5488 formed around the particle 5487. The particle 5487 is a spherical particle in which a surface of one hemisphere is colored in a given color and a surface of the other hemisphere is colored in a different color. Here, the particle 5487 has a white hemisphere and a black hemisphere. Note that there is a difference in electric charge density between the two hemispheres. For this reason, by generating a potential difference between the common electrode 5454 and the pixel electrode 5455, the particle 5487 can be rotated in accordance with the direction of electric fields. The cavity 5488 is filled with a liquid. As the liquid, a liquid similar to the liquid 5483 can be used. Note that the structure of the twisting balls 5486 is not limited to the structure shown in FIG. 18A. For example, the twisting ball 5486 can be a cylinder, an ellipse, or the like.

Figure 18B:
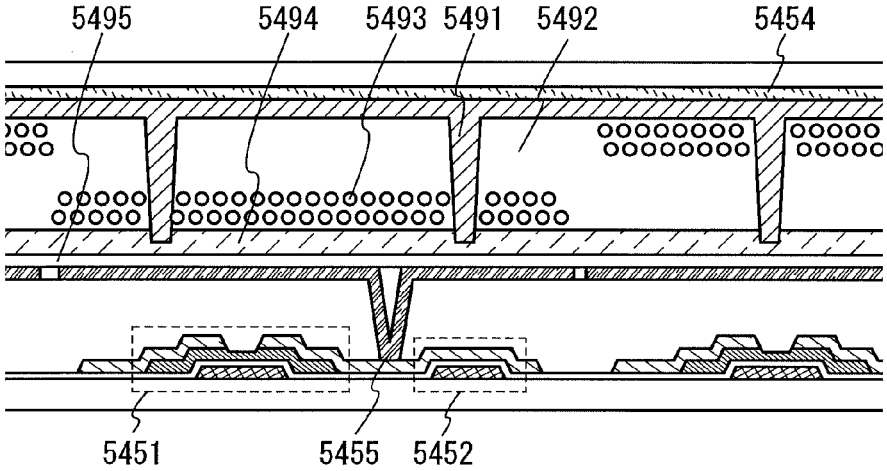

FIG. 18B is a cross-sectional view of a pixel including the display element 5453 using a microcup electrophoresis method. A microcup array can be formed in the following manner: a microcup 5491 that is formed using a UV curable resin or the like and has a plurality of recessed portions is filled with charged pigment particles 5493 dispersed in a dielectric solvent 5492, and sealing is performed with a sealing layer 5494. An adhesive layer 5495 is preferably formed between the sealing layer 5494 and the pixel electrode 5455. As the dielectric solvent 5492, a colorless solvent can be used or a colored solvent of red, blue, or the like can be used. Although Embodiment 7 shows the case where one kind of charged pigment particles is used, two or more kinds of charged pigment particles may be used. The microcup has a wall by which cells are separated, and thus has sufficiently high resistance to shock and pressure. Moreover, since the components of the microcup are tightly sealed, adverse effects due to change in environment can be reduced.

Figure 18C:
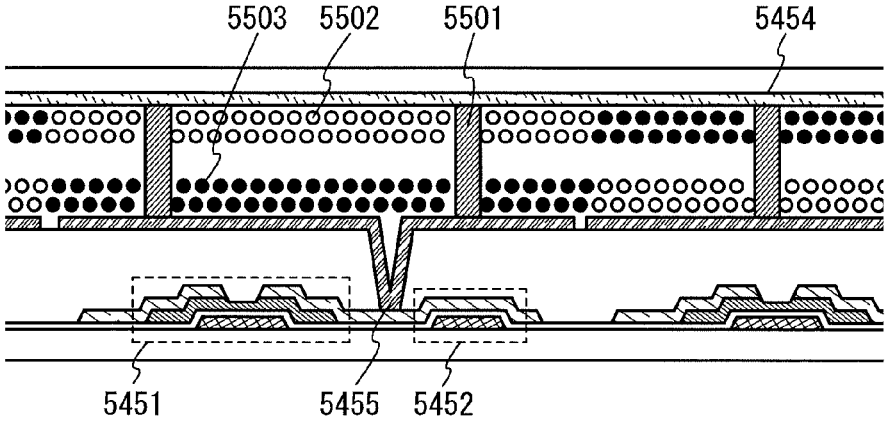

FIG. 18C is a cross-sectional view of a pixel including the display element 5453 using an electronic liquid powder (registered trademark) method. The liquid powders used here have fluidity and is a substance having properties of fluid and properties of a particle. In this method, cells are separated by partitions 5501, and liquid powders 5502 and liquid powders 5503 are placed in the cell. As the liquid powder 5502 and the liquid powder 5503, a white particle and a black particle are preferably used. Note that the kinds of the liquid powders 5502 and 5503 are not limited thereto. For example, colored particles of two colors which are not white and black can be used as the liquid powders 5502 and 5503. As another example, one of the liquid powder 5502 and the liquid powder 5503 can be omitted.

Next, operation of the pixel of Embodiment 7 will be roughly described. The gray level of the display element 5453 is controlled by applying a voltage to the display element 5453 so that an electric field is generated in the display element 5453. A voltage applied to the display element 5453 is controlled by controlling the potential of the common electrode 5454 and the potential of the pixel electrode 5455. Specifically, the potential of the common electrode 5454 is controlled by controlling a voltage applied to the common electrode 5454. The potential of the pixel electrode 5455 is controlled by controlling a signal input to the source signal line 5461. The signal input to the source signal line 5461 is supplied to the pixel electrode 5455 when the transistor 5451 is turned on.

Note that the gray level of the display element 5453 can be controlled by controlling at least one of the intensity of electric fields applied to the display element 5453, the direction of electric fields applied to the display element 5453, the time over which electric fields are applied to the display element 5453, and the like. Note that the gray level of the display element 5453 can be maintained by preventing a potential difference between the common electrode 5454 and the pixel electrode 5455 to be generated.

Figure 23:
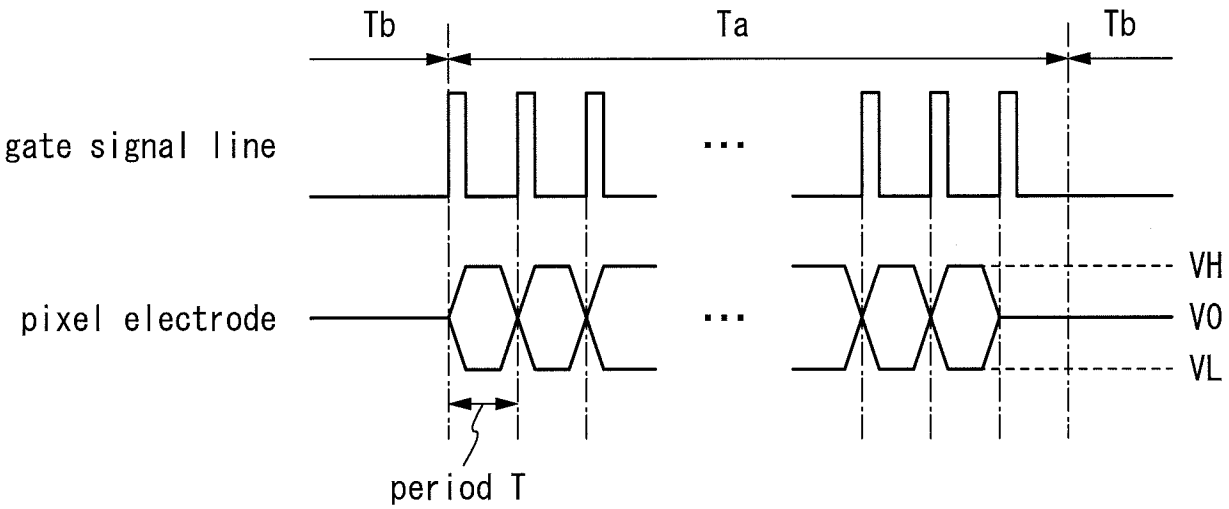
FIG. 23 is a diagram illustrating the display device according to one embodiment of the present invention.

Next, the operation of the pixel of Embodiment 7 will be described in details with reference to FIG. 23. FIG. 23 shows an example of the timing diagram of the pixel in which the grayscale of the display element 5453 is controlled by the time during which a voltage is applied to the display element 5453.

The timing diagram of FIG. 23 shows a period Ta and a period Tb. The period Ta is a period during which an image signal is input to each pixel and the grayscale of the display element 5453 in each pixel is controlled, and is also called a rewrite period or an address period. The period Ta includes a plurality of periods T. In each of the periods T, the pixels are scanned and an image signal is input to the pixels. The period Ta is a period during which the grayscale of the display element 5453 is maintained, and is also called a holding period.

Voltage V0 is applied to the common electrode 5454. The voltage V0 is a predetermined voltage and is also called common voltage.

An image signal input to the source signal line 5461 has at least three potentials. The three potentials of an image signal are a potential higher than the potential of the common electrode 5454 (a potential VH), a potential equal to the potential of the common electrode 5454 (a potential V0), and a potential lower than the potential of the common electrode 5454 (a potential VL). In other words, the potential VH, the potential V0, and the potential VL are selectively applied to the source signal line 5461.

In each of the plurality of periods T in the period Ta, a voltage applied to the display element 5453 can be controlled by controlling a potential applied to the pixel electrode 5455. For example, when the potential VH is applied to the pixel electrode 5455, the potential difference between the common electrode 5454 and the pixel electrode 5455 becomes (VH−V0). Consequently, a positive voltage is applied to the display element 5453. When the potential V0 is applied to the pixel electrode 5455, the potential difference between the common electrode 5454 and the pixel electrode 5455 becomes zero.

Consequently, zero voltage is applied to the display element 5453. When the potential VL is applied to the pixel electrode 5455, the potential difference between the common electrode 5454 and the pixel electrode 5455 becomes (VL−V0). Consequently, a negative voltage is applied to the display element 5453. As described above, in the period Ta, a positive voltage (VH−V0), a negative voltage (VL−V0), and zero voltage can be applied to the display element 5453 in a variety of orders by controlling a voltage applied to the display element 5453 in each of the periods T. Thus, in each pixel, the grayscale of the display element 5453 can be minutely controlled by fewer kinds of image signals.

In the last period T in the period Ta, an image signal having a value equal to the potential of the common electrode 5454 is input to each pixel. In other words, the potential V0 is input to the pixel electrode 5455 in each pixel, and zero voltage is input to the display element 5453 in each pixel.

In the period Tb, the pixel in each row is not selected. In other words, an image signal is not input to the pixels. Consequently, in the period Tb, the pixels keep holding an image signal input to them in the last period T in the period Ta. As described above, in the last period T in the period Ta, an image signal having a value equal to the potential of the common electrode 5454 is input to each pixel. Consequently, in the period Tb, zero voltage keeps being input to the display element 5453 in each pixel. As a result, in each pixel, the grayscale of the display element 5453 is maintained, thereby holding an image displayed on the display area.

Note that for convenience sake, when a positive voltage is applied to the display element 5453, the grayscale of the display element 5453 is close to black (also referred to as a first grayscale). In contrast, when a negative voltage is applied to the display element 5453, the grayscale of the display element 5453 is close to white (also referred to as a second grayscale).

Note that it is preferable that the closer to the first grayscale the grayscale of the display element 5453, the longer the time during which the potential VH is applied to the pixel electrode 5455 in the period Ta; the higher the frequency of application of the potential VH to the pixel electrode 5455 in the plurality of periods T; the longer the time obtained by subtracting the time during which the potential VL is applied to the pixel electrode 5455 from the time during which the potential VH is applied to the pixel electrode 5455 in the period Ta; or the higher the frequency obtained by subtracting the frequency of application of the potential VL to the pixel electrode 5455 from the frequency of application of the potential VH to the pixel electrode 5455 in the plurality of periods T.

Note that it is preferable that the closer to the second grayscale the grayscale of the display element 5453, the longer the time during which the potential VL is applied to the pixel electrode 5455 in the period Ta; the higher the frequency of application of the potential VL to the pixel electrode 5455 in the plurality of periods T; the longer the time obtained by subtracting the time during which the potential VH is applied to the pixel electrode 5455 from the time during which the potential VL is applied to the pixel electrode 5455 in the period Ta; or the higher the frequency obtained by subtracting the frequency of application of the potential VH to the pixel electrode 5455 from the frequency of application of the potential VL to the pixel electrode 5455 in the plurality of periods T.

Note that in the period Ta, a combination of potentials (the potential VH, the potential V0, and the potential VL) applied to the pixel electrode 5455 may depend not only on a grayscale to be subsequently expressed by the display element 5453, but also on a grayscale currently being expressed by the display element 5453. In addition, if a grayscale currently being expressed by the display element 5453 changes, a combination of potentials applied to the pixel electrode 5455 may vary even when a grayscale to be subsequently expressed by the display element 5453 remains unchanged.

For example, it is preferable that the longer the time during which the potential VH is applied to the pixel electrode 5455 in the period Ta during which the grayscale currently being expressed by the display element 5453 is expressed; the longer the time obtained by subtracting the time during which the potential VL is applied to the pixel electrode 5455 from the time during which the potential VH is applied to the pixel electrode 5455 in the period Ta during which the grayscale currently being expressed by the display element 5453 is expressed; the higher the frequency of application of the potential VH to the pixel electrode 5455 in the plurality of periods T; or the higher the frequency obtained by subtracting the frequency of application of the potential VL to the pixel electrode 5455 from the frequency of application of the potential VH to the pixel electrode 5455 in the plurality of periods T, the longer the time during which the potential VL is applied to the pixel electrode 5455 in the period Ta; the higher the frequency of application of the potential VL to the pixel electrode 5455 in the plurality of periods T; the longer the time obtained by subtracting the time during which the potential VH is applied to the pixel electrode 5455 from the time during which the potential VL is applied to the pixel electrode 5455 in the period Ta; or the higher the frequency obtained by subtracting the frequency of application of the potential VH to the pixel electrode 5455 from the frequency of application of the potential VL to the pixel electrode 5455 in the plurality of periods T. In such a manner, afterimages can be reduced.

For example, it is preferable that the longer the time during which the potential VL is applied to the pixel electrode 5455 in the period Ta during which the grayscale currently being expressed by the display element 5453 is expressed; the longer the time obtained by subtracting the time during which the potential VH is applied to the pixel electrode 5455 from the time during which the potential VL is applied to the pixel electrode 5455 in the period Ta during which the grayscale currently being expressed by the display element 5453 is expressed; the higher the frequency of application of the potential VL to the pixel electrode 5455 in the plurality of periods T; or the higher the frequency obtained by subtracting the frequency of application of the potential VH to the pixel electrode 5455 from the frequency of application of the potential VL to the pixel electrode 5455 in the plurality of periods T, the longer the time during which the potential VH is applied to the pixel electrode 5455 in the period Ta; the higher the frequency of application of the potential VH to the pixel electrode 5455 in the plurality of periods T; the longer the time obtained by subtracting the time during which the potential VL is applied to the pixel electrode 5455 from the time during which the potential VH is applied to the pixel electrode 5455 in the period Ta; or the higher the frequency obtained by subtracting the frequency of application of the potential VL to the pixel electrode 5455 from the frequency of application of the potential VH to the pixel electrode 5455 in the plurality of periods T. In such a manner, afterimages can be reduced.

The plurality of periods T has the same length. This simplifies the configuration of the signal line driver circuit. Note that the lengths of at least two of the plurality of periods T may be different. It is preferable to assign weights to the length of the plurality of periods T, in particular. For example, in the case where the plurality of periods consists of 4 periods, the length of the first period T is denoted by a time h, and the length of the second period T is a time h×2; the length of the third period T is a time h×4, and the length of the fourth period T is a time h×8. Assigning weights to the length of the plurality of periods T in such a manner reduces the frequency of selection of the pixels 5450 and enables the time during which a voltage is applied to the display element 5453 to be minutely controlled. Consequently, power consumption can be reduced.

Note that the potential VH and the potential VL may be selectively applied to the common electrode 5454. In this case, it is preferable to selectively apply the potential VH and the potential VL also to the pixel electrode 5455. For example, in the case where the potential VH is applied to the common electrode 5454, zero voltage is applied to the display element 5453 when the potential VH is applied to the pixel electrode 5455, whereas a negative voltage is applied to the display element 5453 when the potential VL is applied to the pixel electrode 5455. On the other hand, in the case where the potential VL is applied to the common electrode 5454, a positive voltage is applied to the display element 5453 when the potential VH is applied to the pixel electrode 5455, whereas zero voltage is applied to the display element 5453 when the potential VL is applied to the pixel electrode 5455. Thus, the signal input to the source signal line 5461 can be a binary signal (a digital signal). For this reason, it is possible to simplify a circuit that outputs a signal to the source signal line 5461.

Note that in the period Tb or part of the period Tb, a signal may be not input to the source signal line 5461 and/or the gate signal line 5462. In other words, the source signal line 5461 and the gate signal line 5462 may be set floating. Note that in the period Tb or part of the period Tb, a signal may be not input to the wiring 5463. In other words, the wiring 5463 may be set floating. Note that in the period Tb or part of the period Tb, a voltage may be not applied to the common electrode 5454. In other words, the common electrode 5454 may be set floating. Note that in the period Tb or part of the period Tb, zero voltage may be applied to the source signal line 5461. This allows a potential difference between the drain and the source of the transistor 5451 to be 0 V in each pixel, thereby reducing variations in the potential of the pixel electrode 5455.

Embodiment 7 can be combined with any of the other embodiments as appropriate.

Embodiment 8

In Embodiment 8, examples of a transistor that can be applied to a display device that is one embodiment of the present invention will be described.

FIGS. 19A to 19D each show an example of a cross-sectional structure of a transistor.

Figure 19A:
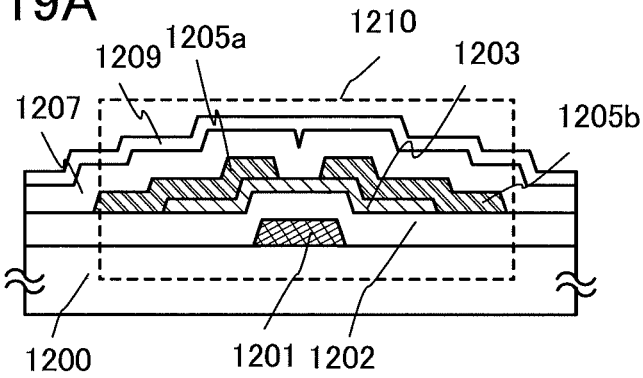
FIGS. 19A to 19D are diagrams illustrating display devices according to one embodiment of the present invention.

A transistor 1210 shown in FIG. 19A is a bottom-gate transistor (also called an inverted staggered transistor).

The transistor 1210 includes, over a substrate 1200 having an insulating surface, a gate electrode layer 1201, a gate insulating layer 1202, a semiconductor layer 1203, a source electrode layer 1205*a*, and a drain electrode layer 1205*b*. An insulating layer 1207 is formed to cover the transistor 1210 and be stacked over the semiconductor layer 1203. A protective insulating layer 1209 is formed over the insulating layer 1207.

Figure 19B:
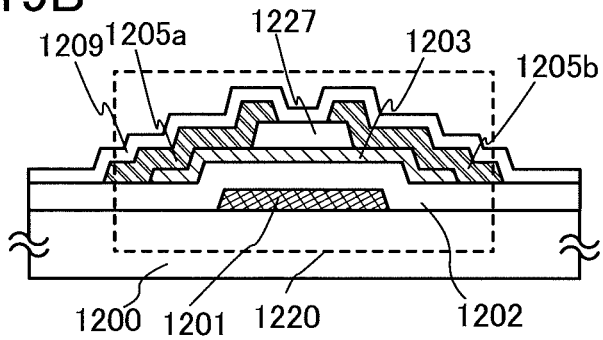

A transistor 1220 shown in FIG. 19B is a channel-protective type (channel-stop type) transistor, a kind of the bottom-gate transistor (also called an inverted staggered transistor).

The transistor 1220 includes, over a substrate 1200 having an insulating surface, a gate electrode layer 1201, a gate insulating layer 1202, a semiconductor layer 1203, an insulating layer 1227 that is formed over a channel formation region in the semiconductor layer 1203 and functions as a channel protective layer, a source electrode layer 1205*a*, and a drain electrode layer 1205*b*. A protective insulating layer 1209 is formed to cover the transistor 1220.

Figure 19C:
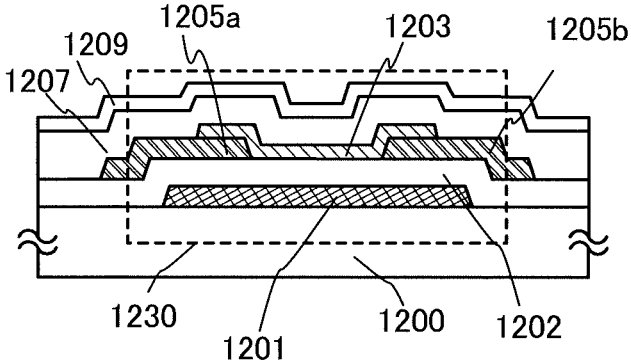

A transistor 1230 shown in FIG. 19C is a bottom-gate transistor and includes, over a substrate 1200 which is a substrate having an insulating surface, a gate electrode layer 1201, a gate insulating layer 1202, a source electrode layer 1205*a*, a drain electrode layer 1205*b*, and a semiconductor layer 1203. An insulating layer 1207 is formed to cover the transistor 1230 and be in contact with the semiconductor layer 1203. A protective insulating layer 1209 is formed over the insulating layer 1207.

In the transistor 1230, the gate insulating layer 1202 is formed in contact with the substrate 1200 and the gate electrode layer 1201. The source electrode layer 1205*a* and the drain electrode layer 1205*b* are formed in contact with the gate insulating layer 1202. The semiconductor layer 1203 is formed over the gate insulating layer 1202, the source electrode layer 1205*a*, and the drain electrode layer 1205*b*.

Figure 19D:
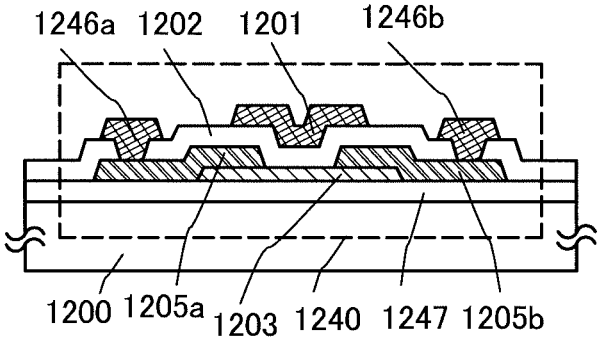

A transistor 1240 shown in FIG. 19D is a top-gate transistor. The transistor 1240 includes, over a substrate 1200 having an insulating surface, an insulating layer 1247, a semiconductor layer 1203, a source electrode layer 1205*a* and a drain electrode layer 1205*b*, a gate insulating layer 1202, and a gate electrode layer 1201. A wiring layer 1246*a* and a wiring layer 1246*b* are formed in contact with the source electrode layer 1205*a* and the drain electrode layer 1205*b*, respectively, to be electrically connected to the source electrode layer 1205*a* and the drain electrode layer 1205*b*, respectively.

In Embodiment 8, the semiconductor layer 1203 contains an oxide semiconductor.

Examples of oxide semiconductors are an In—Sn—Ga—Zn—O-based metal oxide which is an oxide of four metal elements; an In—Ga—Zn—O-based metal oxide, an In—Sn—Zn—O-based metal oxide, an In—Al—Zn—O-based metal oxide, a Sn—Ga—Zn—O-based metal oxide, an Al—Ga—Zn—O-based metal oxide, and a Sn—Al—Zn—O-based metal oxide which are oxides of three metal elements; an In—Zn—O-based metal oxide, a Sn—Zn—O-based metal oxide, an Al—Zn—O-based metal oxide, a Zn—Mg—O-based metal oxide, a Sn—Mg—O-based metal oxide, and an In—Mg—O-based metal oxide which are oxides of two metal elements; an In—O-based metal oxide, a Sn—O-based metal oxide, and a Zn—O-based metal oxide. Further, the above-described metal oxide semiconductor may contain $SiO_2$. Here, for example, an In—Ga—Zn—O-based metal oxide is an oxide containing at least In, Ga, and Zn and has no particular limitation on the composition ratio of the elements. An In—Ga—Zn—O-based metal oxide may contain an element other than In, Ga, and Zn.

For the oxide semiconductor, a thin film expressed by the chemical formula of $InMO_3(ZnO)_m$ (m is greater than zero and is not a natural number) can be used. Here, M represents one or more metal elements selected from Ga, Al, Mn, and Co. For example, M can be Ga, Ga and Al, Ga and Mn, or Ga and Co. The oxide semiconductor material represented by In—Ga—Zn—O described in this specification is $InGaO_3(ZnO)_m$ (m is greater than zero and is not a natural number). The fact that m is not a natural number can be confirmed by analysis using ICP-MS or RBS.

Note that in the structure in Embodiment 8, the oxide semiconductor is an intrinsic (i-type) or substantially intrinsic semiconductor obtained by removal of hydrogen, which is an n-type impurity, from the oxide semiconductor for high purification so that the oxide semiconductor contains an impurity other than the main component as little as possible. In other words, the oxide semiconductor in Embodiment 8 is a purified i-type (intrinsic) semiconductor or a substantially intrinsic semiconductor obtained by removing impurities such as hydrogen and water as much as possible, not by adding an impurity element. In addition, the band gap of the oxide semiconductor is 2 eV or more, preferably 2.5 eV or more, further preferably 3.0 eV or more. Thus, in the oxide semiconductor layer, the generation of carriers due to thermal excitation can be suppressed. Therefore, it is possible to suppress the increase in off-state current due to rise in operation temperature of a transistor in which a channel formation region is formed using the oxide semiconductor.

The number of carriers in the purified oxide semiconductor is very small (close to zero), and the carrier concentration is less than $1\times10^{14}/cm^3$, preferably less than $1\times10^{12}/cm^3$, further preferably less than $1\times10^{11}/cm^3$.

The number of carriers in the oxide semiconductor is so small that the off-state current of the transistor can be reduced. Specifically, the off-state current per channel width of 1 μm of the transistor in which the above-described oxide semiconductor is used for a semiconductor layer can be reduced to 10 aA/μm ($1\times10^{-17}$ A/μm) or lower, further reduced to 1 aA/μm ($1\times10^{-18}$ A/μm) or lower, and still further reduced to 10 zA/μm ($1\times10^{-20}$ A/μm). In other words, in circuit design, the oxide semiconductor can be regarded as an insulator when the transistor is off. Moreover, when the transistor is on, the current supply capability of the oxide semiconductor layer is expected to be higher than that of a semiconductor layer formed of amorphous silicon.

In each of the bottom-gate transistors 1210, 1220, 1230, and 1240 in which the oxide semiconductor is used for the semiconductor layer 1203, the current in an off state (the off-state current) can be low. Therefore, variations in the potential of the pixel electrode due to the off-state current of the transistor can be reduced, thereby making the refresh rate higher. Thus, the power consumption can be reduced. Alternatively, the pixel size can be reduced since storage capacitance can be omitted or reduced. Consequently, the resolution can be improved.

In addition, the withstand voltage of the bottom-gate transistors 1210, 1220, 1230, and 1240 in which an oxide semiconductor is used for the semiconductor layer 1203 can be increased. Display elements having memory properties are known to need a high voltage to be driven generally. For this reason, a high voltage is applied to the transistors in the pixels or the signal line driver circuit. Therefore, transistors using an oxide semiconductor are preferable for display devices displaying an image by display elements having memory properties.

Although there is no particular limitation on a substrate that can be used as the substrate 1200 having an insulating surface, the substrate needs to have such heat resistance that it can withstand heat treatment to be performed later. A glass substrate made of barium borosilicate glass, aluminoborosilicate glass, or the like can be used.

In the case where the temperature of heat treatment to be performed later is high, a glass substrate whose strain point is 730° C. or more is preferably used. For a glass substrate, a glass material such as aluminosilicate glass, aluminoborosilicate glass, or barium borosilicate glass is used, for example. Note that a glass substrate containing a larger amount of barium oxide (BaO) than boron oxide ($B_2O_3$), which is practical heat-resistant glass, may be used.

Note that a substrate formed of an insulator, such as a ceramic substrate, a quartz substrate, or a sapphire substrate, may be used instead of the glass substrate. Alternatively, crystallized glass or the like may be used. A plastic substrate or the like can be used as appropriate.

In the bottom-gate transistors 1210, 1220, and 1230, an insulating film serving as a base film may be formed between the substrate and the gate electrode layer. The base film has a function of preventing diffusion of an impurity element from the substrate, and can be a single layer or stack of a silicon nitride film, a silicon oxide film, a silicon nitride oxide film, and/or a silicon oxynitride film.

The gate electrode layer 1201 can be a single layer or stack using a metal material such as molybdenum, titanium, chromium, tantalum, tungsten, aluminum, copper, neodymium, or scandium or an alloy material containing any of these materials as its main component.

A two-layer stack that may be used as the gate electrode layer 1201 is preferably any of the following: a two-layer stack of an aluminum layer overlaid by a molybdenum layer, a two-layer stack of a copper layer overlaid by a molybdenum layer, a two-layer stack of a copper layer overlaid by a titanium nitride layer or a tantalum nitride layer, and a two-layer stack of a titanium nitride layer and a molybdenum layer, for example. A three-layer stack that may be used as the gate electrode layer 1201 is preferably a stack of either a tungsten layer or a tungsten nitride layer, either an alloy layer of aluminum and silicon or an alloy layer of aluminum and titanium, and either a titanium nitride layer or a titanium layer. Note that the gate electrode layer can be formed using a light-transmitting conductive film. An example of a material for the light-transmitting conductive film is a light-transmitting conductive oxide.

The gate insulating layer 1202 can be a single layer or a stack of any of the following: a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, and a hafnium oxide layer, and can be formed by plasma CVD, sputtering, or the like.

The gate insulating layer 1202 can be a stack in which a silicon nitride layer and a silicon oxide layer are stacked from the gate electrode layer side. For example, a 100-nm-thick gate insulating layer is formed in such a manner that a first gate insulating layer that is a silicon nitride layer ($SiN_y$ (y>0)) having a thickness of 50 nm to 200 nm is formed by sputtering and then a second gate insulating layer that is a silicon oxide layer ($SiO_x$ (x>0)) having a thickness of 5 nm to 300 nm is stacked over the first gate insulating layer. The thickness of the gate insulating layer 1202 may be set as appropriate depending on characteristics needed for a transistor, and may be approximately 350 nm to 1200 nm.

For a conductive film used for the source electrode layer 1205*a* and the drain electrode layer 1205*b*, an element selected from Al, Cr, Cu, Ta, Ti, Mo, and W, an alloy containing any of these elements, or an alloy film containing a combination of any of these elements can be used, for example. A structure may be employed in which a high-melting-point metal layer of Cr, Ta, Ti, Mo, W, or the like is stacked on one or both of a top surface and a bottom surface of a metal layer of Al, Cu, or the like. By using an aluminum material to which an element preventing generation of hillocks and whiskers in an aluminum film, such as Si, Ti, Ta, W, Mo, Cr, Nd, Sc, or Y, is added, heat resistance can be increased.

A conductive film serving as the wiring layers 1246*a* and 1246*b* connected to the source electrode layer 1205*a* and the drain electrode layer 1205*b* can be formed using a material similar to that of the source and drain electrode layers 1205*a* and 1205*b*.

The source electrode layer 1205*a* and the drain electrode layer 1205*b* may be a single layer or a stack of two or more layers. For example, the source electrode layer 1205*a* and the drain electrode layer 1205*b* each can be any of the following: a single layer of an aluminum film containing silicon, a two-layer stack of an aluminum film overlaid by a titanium film, and a three-layer stack of a titanium film overlaid by an aluminum film overlaid by a titanium film.

The conductive film to be the source electrode layer 1205*a* and the drain electrode layer 1205*b* (including a wiring layer formed using the same layer as the source and drain electrode layers) may be formed using a conductive metal oxide. As the conductive metal oxide, indium oxide ($In_2O_3$), tin oxide ($SnO_2$), zinc oxide (ZnO), an alloy of indium oxide and tin oxide ($In_2O_3$—$SnO_2$, referred to as ITO), an alloy of indium oxide and zinc oxide ($In_2O_3$—ZnO), or any of the metal oxide materials containing silicon or silicon oxide can be used.

As the insulating layers 1207, 1227, and 1247 and the protective insulating layer 1209, an inorganic insulating film such as an oxide insulating film or a nitride insulating film is preferably used.

As the insulating layers 1207, 1227, and 1247, an inorganic insulating film such as a silicon oxide film, a silicon oxynitride film, an aluminum oxide film, or an aluminum oxynitride film can be typically used.

As the protective insulating layer 1209, an inorganic insulating film such as a silicon nitride film, an aluminum nitride film, a silicon nitride oxide film, or an aluminum nitride oxide film can be used.

A planarization insulating film may be formed over the protective insulating layer 1209 in order to reduce surface roughness due to the transistor. The planarization insulating film can be formed using a heat-resistant organic material such as polyimide, acrylic, benzocyclobutene, polyamide, or epoxy. Other than such organic materials, it is possible to use a low-dielectric constant material (a low-k material), a siloxane-based resin, PSG (phosphosilicate glass), BPSG (borophosphosilicate glass), or the like. Note that the planarization insulating film may be formed by stacking a plurality of insulating films of these materials.

Note that not only an oxide semiconductor but amorphous silicon, microcrystalline silicon, or polycrystalline silicon can be used for the semiconductor layer 1203. The low-cost manufacturing of display devices is achieved by using a transistor using amorphous silicon, in particular, in a display device that is one embodiment of the present invention or in the pixel or the signal line driver circuit of the display device.

Embodiment 8 can be implemented in appropriate combination with any of the components described in the other embodiments.

Embodiment 9

In this embodiment, a structure of a display device obtained by adding a touch panel function to the display device of the above embodiments will be described with reference to FIGS. 20A and 20B.

Figure 20A:
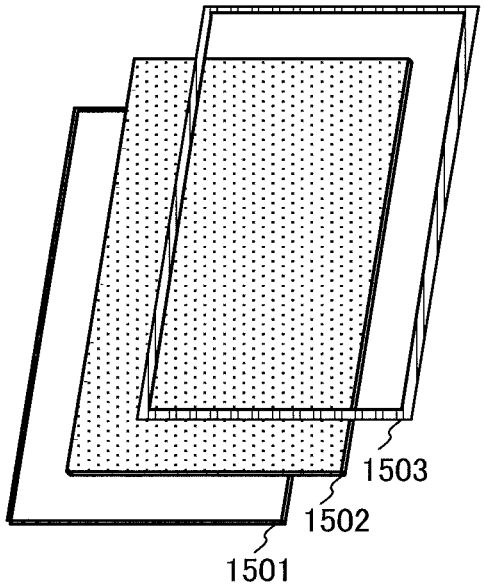
FIGS. 20A and 20B are diagrams illustrating display devices according to one embodiment of the present invention.

FIG. 20A is a schematic diagram of a display device of this embodiment. FIG. 20A shows a structure where a touch panel unit 1502 overlaps a display panel 1501 which is the display device according to the above embodiments and they are attached together in a housing (a case) 1503. For the touch panel unit 1502, a resistive touchscreen, a surface capacitive touchscreen, a projected capacitive touchscreen, or the like can be used as appropriate.

As shown in FIG. 20A, the display panel 1501 and the touch panel unit 1502 are separately fabricated and overlap with each other, so that the cost for manufacturing the display device having a touch panel function can be reduced.

Figure 20B:
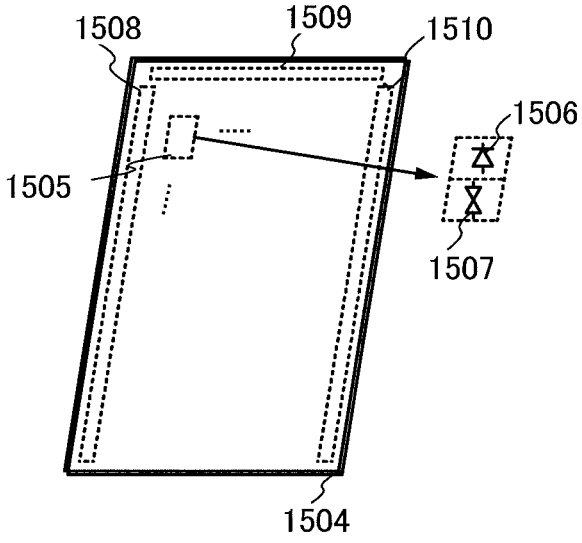

FIG. 20B shows a structure of a display device having a touch panel function, which is different from that shown in FIG. 20A. A display device 1504 shown in FIG. 20B includes a plurality of pixels 1505 each including an optical sensor 1506 and a display element 1507 (e.g., an electrophoretic element or liquid crystal element). Therefore, unlike in FIG. 20A, the touch panel unit 1502 is not necessarily stacked, so that the display device can be reduced in thickness. When a gate signal line driver circuit 1508, a signal line driver circuit 1509, and an optical sensor driver circuit 1510 are formed over a substrate where the pixels 1505 are formed, the display device can be reduced in size. Note that the optical sensor 1506 may be formed using amorphous silicon or the like and overlap with a transistor including an oxide semiconductor.

According to this embodiment, a transistor including an oxide semiconductor film is used in a display device having a touch panel function, so that image retention at the time of displaying a still image can be improved. Moreover, it is possible to reduce deterioration of image quality due to change in grayscale when a still image is displayed with a reduced refresh rate.

Embodiment 9 can be implemented in appropriate combination with any of the components described in the other embodiments.

Embodiment 10

In this embodiment, an example of an electronic appliance including the display device described in any of the above-described embodiments will be described.

Figure 21A:
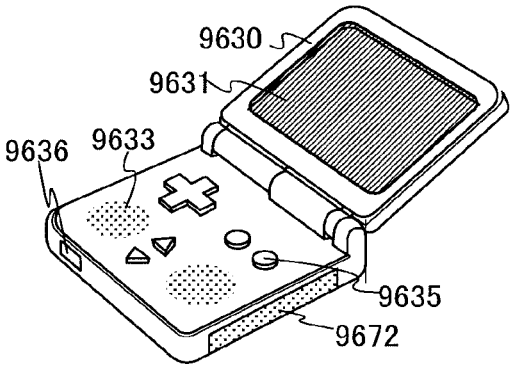
FIGS. 21A to 21D are diagrams illustrating electric appliances according to one embodiment of the present invention.

FIG. 21A shows a portable game console that includes a housing 9630, a display area 9631, a speaker 9633, operation keys 9635, a connection terminal 9636, a recording medium reading portion 9672, and the like. The portable game console in FIG. 21A can have a function of reading a program or data stored in the recording medium to display it on the display area, a function of sharing information with another portable game console by wireless communication, and the like. Note that the functions of the portable game console in FIG. 21A are not limited to those described above, and the portable game console can have various functions.

Figure 21B:
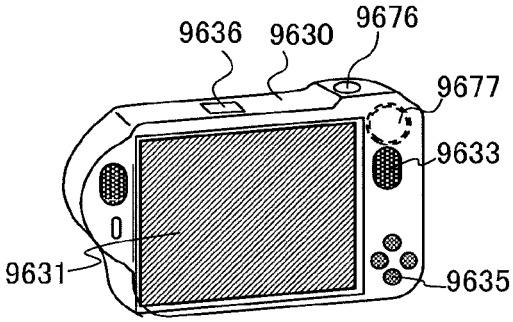

FIG. 21B shows a digital camera that can include a housing 9630, a display area 9631, a speaker 9633, operation keys 9635, a connection terminal 9636, a shutter button 9676, an image receiving portion 9677, and the like. The digital camera in FIG. 21B can have a function of photographing a still image and/or a moving image, a function of automatically or manually correcting the photographed image, a function of obtaining various kinds of information from an antenna, a function of saving the photographed image or the information obtained from the antenna, a function of displaying the photographed image or the information obtained from the antenna on the display area, and the like. Note that the digital camera in FIG. 21B can have a variety of functions without being limited to the above.

Figure 21C:
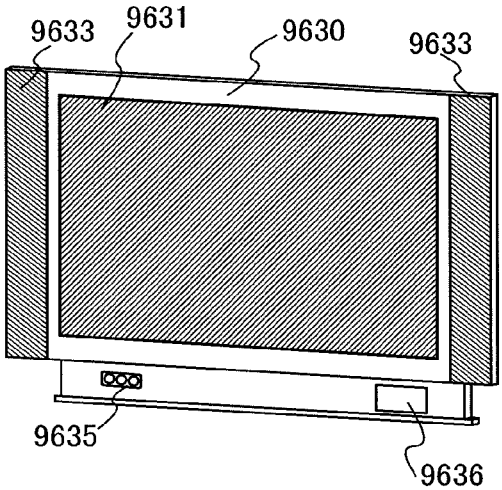

FIG. 21C shows a television set that can include a housing 9630, a display area 9631, speakers 9633, operation keys 9635, a connection terminal 9636, and the like. The television set in FIG. 21C can have a function of converting an electric wave for television into an image signal, a function of converting an image signal into a signal suitable for display, a function of converting the frame frequency of an image signal, and the like. Note that the television set in FIG. 21C can have a variety of functions without being limited to the above.

Figure 21D:
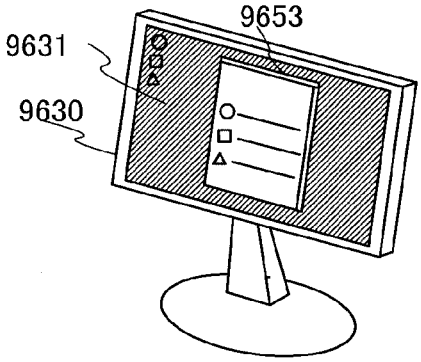

FIG. 21D shows a monitor for electronic computers (personal computers) (the monitor is also referred to as a PC monitor) that can include a housing 9630, a display area 9631, and the like. As an example, in the monitor in FIG. 21D, a window 9653 is displayed on the display area 9631. Note that FIG. 21D shows the window 9653 displayed on the display area 9631 for explanation; a symbol such as an icon or an image may be displayed. In the monitor for a personal computer, an image signal is rewritten only at the time of inputting in many cases, which is preferable to apply the method for driving a display device in the above-described embodiment. Note that the monitor in FIG. 21D can have various functions without being limited to the above.

Figure 22A:
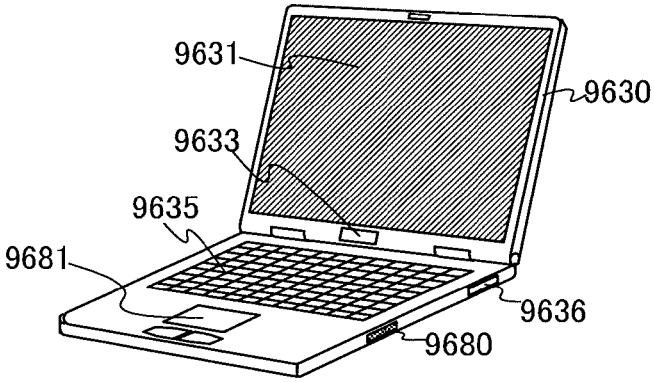
FIGS. 22A to 22D are diagrams illustrating electric appliances according to one embodiment of the present invention.

FIG. 22A shows a computer that can include a housing 9630, a display area 9631, a speaker 9633, operation keys 9635, a connection terminal 9636, a pointing device 9681, an external connection port 9680, and the like. The computer in FIG. 22A can have a function of displaying a variety of information (e.g., a still image, a moving image, and a text image) on the display area, a function of controlling processing by a variety of software (programs), a communication function such as wireless communication or wired communication, a function of being connected to various computer networks with the communication function, a function of transmitting or receiving a variety of data with the communication function, and the like. Note that the computer in FIG. 22A is not limited to having these functions and can have a variety of functions.

Figure 22B:
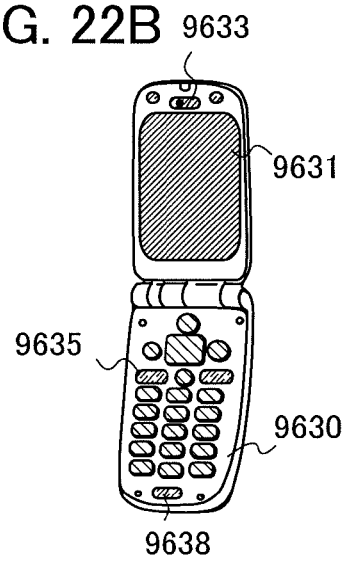

FIG. 22B shows a cellular phone that can include a housing 9630, a display area 9631, a speaker 9633, operation keys 9635, a microphone 9638, and the like. The cellular phone in FIG. 22B can have a function of displaying a variety of information (e.g., a still image, a moving image, and a text image) on the display area; a function of displaying a calendar, a date, the time, or the like on the display area; a function of operating or editing the information displayed on the display area; a function of controlling processing by various kinds of software (programs); and the like. Note that the functions of the cellular phone in FIG. 22B are not limited to those described above, and the cellular phone can have various functions.

Figure 22C:
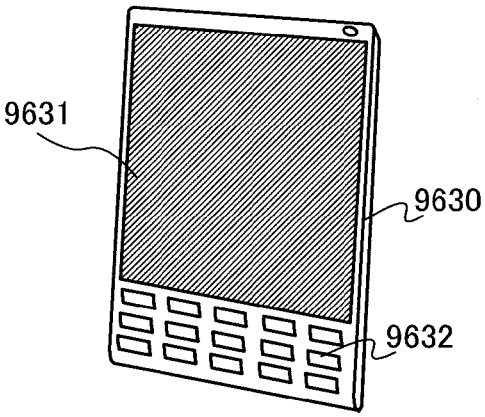
Figure 22D:
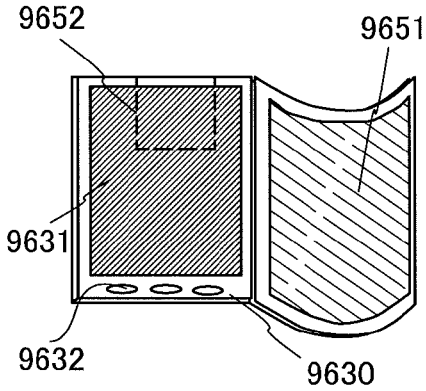

FIG. 22C shows an electronic appliance including electronic paper (also referred to as an eBook or an e-book reader) that can include a housing 9630, a display area 9631, operation keys 9632, and the like. The e-book reader in FIG. 22C can have a function of displaying a variety of information (e.g., a still image, a moving image, and a text image) on the display area; a function of displaying a calendar, a date, the time, and the like on the display area; a function of operating or editing the information displayed on the display area; a function of controlling processing by various kinds of software (programs); and the like. Note that the e-book reader in FIG. 22C can have a variety of functions without being limited to the above functions. FIG. 22D shows another structure of an e-book reader. The e-book reader in FIG. 22D has a structure obtained by adding a solar battery 9651 and a battery 9652 to the e-book reader in FIG. 22C. When a reflective display device is used as the display area 9631, the e-book reader is expected to be used in a comparatively bright environment, in which case the structure in FIG. 22D is preferable because the solar battery 9651 can efficiently generate power and the battery 9652 can efficiently charge power. Note that when a lithium ion battery is used as the battery 9652, an advantage such as reduction in size can be obtained.

The electronic appliances of Embodiment 10 each include a display device that is one embodiment of the present invention, so that their display quality can be improved.

Embodiment 10 can be implemented in appropriate combination with any of the other embodiments.

This application is based on Japanese Patent Application serial no. 2010-093394 filed with Japan Patent Office on Apr. 14, 2010, the entire contents of which are hereby incorporated by reference.

What is claimed is:

1. A display device comprising:

a display area in which a plurality of pixels, a plurality of gate signal lines, and a plurality of source signal lines divided into N groups are arranged in a matrix, N being a natural number, each of the plurality of pixels including a transistor and a display element being sandwiched between a pixel electrode and a common electrode and having memory properties;

a scan line driver circuit configured to control a timing of selecting any one of the plurality of gate signal lines; and a signal line driver circuit configured to control, in a period during which the scan line driver circuit selects any one of the plurality of gate signal lines, a timing of outputting a first signal to the source signal lines in the second to N-th groups and concurrently outputting a second signal simultaneously to all of the source signal lines in the first group, and then outputting the second signal simultaneously to the source signal lines in each of the second to N-th groups, sequentially group by group, wherein a first terminal of the transistor is electrically connected to any one of the plurality of source signal lines, wherein a second terminal of the transistor is electrically connected to the pixel electrode, and wherein a gate of the transistor is electrically connected to any one of the plurality of gate signal lines.

2. The display device according to claim 1, wherein an absolute value of a difference between a potential of the first signal and a potential of the common electrode is lower than an absolute value of a threshold voltage of the display element.

3. The display device according to claim 1, wherein the second signal has three values: a value approximately the same as a potential of the common electrode, a value higher than the potential of the common electrode, and a value lower than the potential of the common electrode.

4. An electronic appliance configured to communicate with the display device according to claim 1.

5. A display device comprising:

a display area in which a plurality of pixels, a plurality of gate signal lines, and a plurality of source signal lines divided into N groups are arranged in a matrix, N being a natural number, each of the plurality of pixels including a transistor and a display element being sandwiched between a pixel electrode and a common electrode and having memory properties;

a scan line driver circuit configured to control a timing of selecting any one of the plurality of gate signal lines; and a signal line driver circuit configured to control, in a period during which the scan line driver circuit selects any one of the plurality of gate signal lines, a timing of outputting a first signal to the source signal lines in the second to N-th groups and concurrently outputting a second signal simultaneously to all of the source signal lines in the first group, and then outputting the second signal simultaneously to the source signal lines in each of the second to N-th groups, sequentially group by group, wherein a first terminal of the transistor is electrically connected to any one of the plurality of source signal lines, wherein a second terminal of the transistor is electrically connected to the pixel electrode, wherein a gate of the transistor is electrically connected to any one of the plurality of gate signal lines, and wherein a potential of the first signal is substantially equal to a potential of the common electrode.

6. The display device according to claim 5, wherein an absolute value of a difference between the potential of the first signal and the potential of the common electrode is lower than an absolute value of a threshold voltage of the display element.

7. The display device according to claim 5, wherein the second signal has three values: a value approximately the same as the potential of the common electrode, a value higher than the potential of the common electrode, and a value lower than the potential of the common electrode.

8. An electronic appliance configured to communicate with the display device according to claim 5.

* * * * *